US011737578B1

(12) United States Patent
Bickel

(10) Patent No.: US 11,737,578 B1
(45) Date of Patent: Aug. 29, 2023

(54) PLAYYARD FLOOR APPARATUS

(71) Applicant: Regalo International, LLC, Burnsville, MN (US)

(72) Inventor: Shannon R. Bickel, Lakeville, MN (US)

(73) Assignee: Regalo International, LLC, Burnsville, MN (US)

( * ) Notice: Subject to any disclaimer, the term of this patent is extended or adjusted under 35 U.S.C. 154(b) by 114 days.

(21) Appl. No.: 17/349,878

(22) Filed: Jun. 16, 2021

Related U.S. Application Data

(60) Provisional application No. 63/042,542, filed on Jun. 22, 2020.

(51) Int. Cl.
*A47D 13/06* (2006.01)

(52) U.S. Cl.
CPC ..... *A47D 13/063* (2013.01)

(58) Field of Classification Search
CPC .... A47D 13/06; A47D 13/061; A47D 13/063; A47D 13/065; A47D 13/066; A47D 13/068
See application file for complete search history.

(56) References Cited

U.S. PATENT DOCUMENTS 1,950,603 A * 3/1934 Fischer ..... A47D 13/065 256/25
2,563,915 A * 8/1951 Boisselier ..... A47D 13/063 5/98.3
5,088,139 A * 2/1992 Bloom ..... A47D 13/08 190/1
D582,676 S * 12/2008 Rothschild ..... D3/276
8,635,721 B2 * 1/2014 Zhang ..... A47D 13/063 5/98.1
9,144,325 B1 * 9/2015 Sousa ..... A47D 13/063
9,706,854 B1 * 7/2017 Zhou ..... A47D 7/04
9,763,523 B2 * 9/2017 Thomson ..... A47D 7/005
9,848,714 B2 * 12/2017 Burns ..... A47D 13/06
10,194,755 B1 * 2/2019 Flannery ..... A47D 13/063
10,448,752 B1 * 10/2019 Flannery ..... A47D 13/063
10,674,835 B1 6/2020 Flannery et al.
11,026,522 B1 6/2021 Flannery et al.
11,266,253 B1 * 3/2022 Flannery ..... A47D 15/00
2005/0034232 A1 * 2/2005 Martin ..... A47D 7/04 5/93.1
2005/0150046 A1 * 7/2005 Gehr ..... A47D 13/063 5/99.1
2012/0216346 A1 * 8/2012 Rampton ..... A47D 13/061 256/25

(Continued)

*Primary Examiner* — David R Hare
*Assistant Examiner* — George Sun

(57) ABSTRACT

The present playyard floor apparatus includes a lower floor that is essentially one-piece with a flexible pen and an upper floor that is removably engaged to the lower floor with a quick connect mechanism. The quick connect mechanism has inner and outer portions. The inner portion of the quick connect mechanism is disposed on the underside of the upper floor and spaced from a periphery of the upper floor. The outer portion of the quick connect mechanism is engaged to a periphery of the lower floor and includes interlocking elements that are spaced from the periphery of the lower floor. The upper floor is resilient and extends over the inner and outer portions of the quick connect mechanism and further extends to the sidewall of the flexible pen.

19 Claims, 13 Drawing Sheets

(56) References Cited

U.S. PATENT DOCUMENTS

| | | | | |
|---|---|---|---|---|
| 2014/0208505 | A1* | 7/2014 | Burkholder | A47D 7/002 5/99.1 |
| 2018/0214728 | A1* | 8/2018 | Ben Meir | E04H 4/0056 |
| 2020/0352352 | A1* | 11/2020 | Fusco | A47D 13/061 |
| 2020/0352353 | A1* | 11/2020 | Fusco | A47D 13/061 |
| 2021/0137280 | A1* | 5/2021 | Villano | A47D 15/008 |

* cited by examiner

PLAYYARD FLOOR APPARATUS

This application claims the benefit under 35 U.S.C. 119(e) of U.S. Provisional Patent Application No. 63/042,542 filed Jun. 22, 2020, which application is hereby incorporated by reference in its entirety into this application.

FIELD OF THE INVENTION

The present invention relates to a playyard floor apparatus, particularly a playyard floor apparatus with a flexible pen having a sidewall and lower floor, and specifically to such a playyard floor apparatus having an upper floor engaged to the flexible pen with a quick connect mechanism.

BACKGROUND OF THE INVENTION

Velcro® material is a popular quick connect. It is strong, it is easy and quick to connect, and it is easy and quick to disconnect. Velcro® material includes hooks on one connector portion and loops on the other connector portion. A disadvantage of Velcro® material is that it attracts and captures dirt, short fine hair, short fine fibers, fuzz, and other matter. When captured, the fuzz, hair, and fibers are difficult to remove from the Velcro® material.

An alternative to Velcro® material is the 3M™ Dual Lock™ material. Like Velcro® material, the Dual Lock™ material is a re-closeable fastener and a quick connect. One connector portion of the Dual Lock™ material includes mushroom shaped heads. The other connector portion of the Dual Lock™ material also includes mushroom shaped heads. The opposing mushroom shaped heads interlock with each other. The Dual Lock™ material is strong, easy and quick to connect, and easy and quick to disconnect.

SUMMARY OF THE INVENTION

A feature of the present invention is the provision in a playyard, of a frame, where the frame is endless, where the frame includes upper junctions, intermediate junctions, and lower junctions, and where the frame is a scissoring frame.

Another feature of the present invention is the provision in a playyard, of a flexible pen, where the flexible pen is engaged to the frame, where the flexible pen is disposed inwardly of the frame, where the flexible pen includes a sidewall, a lower floor, and an open top, and where the sidewall and lower floor are flexible.

Another feature of the present invention is the provision in a playyard, of the frame and flexible pen being foldable up from an open configuration into a closed configuration for storage with the flexible pen disposed inwardly of the frame.

Another feature of the present invention is the provision in a playyard, of the frame and flexible pen being foldable out from the closed configuration to the open configuration with the flexible pen disposed inwardly of the frame.

Another feature of the present invention is the provision in a playyard, of an upper floor, where the upper floor is flexible, where the upper floor is disposed at a greater elevation than the lower floor, where the upper floor is engagable to the flexible pen, and where the upper floor is disengagable from the flexible pen.

Another feature of the present invention is the provision in a playyard, of the sidewall and lower floor being engaged to each other at a junction, and where a disengagement of the lower floor from the sidewall destroys an integrity of the junction between the sidewall and lower floor.

Another feature of the present invention is the provision in a playyard, of the upper floor including an upper floor periphery, an underside, and an inner zipper portion, where the inner zipper portion includes an inner flexible strip and inner teeth on an outer edge of the inner flexible strip, where the inner flexible strip is engaged to the underside of the upper floor, where the inner flexible strip is spaced from the upper floor periphery and the inner teeth of the inner flexible strip are spaced from the upper floor periphery.

Another feature of the present invention is the provision in a playyard, of the flexible pen including an outer zipper portion, where the outer zipper portion includes an outer flexible strip and outer teeth on an inner edge of the outer flexible strip, where the outer flexible strip are engaged to the flexible pen and the outer teeth are spaced inwardly from the sidewall of the flexible pen.

Another feature of the present invention is the provision in a playyard, of the inner teeth of the inner zipper portion engaging the outer teeth of the outer zipper portion to engage the upper floor to the flexible pen.

Another feature of the present invention is the provision in a playyard, of the upper floor covering the inner and outer teeth, respectively, of the inner and outer zipper portions.

Another feature of the present invention is the provision in a playyard, of a quick connect mechanism between the upper floor and the flexible pen, where the quick connect mechanism includes an inner portion engaged to the upper floor and an outer portion engaged to the flexible pen, where each of the inner and outer portions of the quick connect mechanism include interlocking elements, and where the inner and outer portions of the quick connect mechanism are engaged to each other by the interlocking elements.

Another feature of the present invention is the provision in a playyard, of the upper floor including a periphery, wherein the upper floor includes an underside, where the inner portion of the quick connect mechanism is engaged to the underside of the upper floor, and where the inner portion of the quick connect mechanism is spaced from the periphery of the upper floor.

Another feature of the present invention is the provision in a playyard, of the upper floor including a periphery, where the upper floor includes an underside, where the inner portion of the quick connect mechanism is engaged to the underside of the upper floor, and where the interlocking elements of the inner portion of the quick connect mechanism are spaced from the periphery of the upper floor.

Another feature of the present invention is the provision in a playyard, of the upper floor extending over the interlocking elements of the inner portion of the quick connect mechanism.

Another feature of the present invention is the provision in a playyard, of the upper floor extending over the inner portion of the quick connect mechanism.

Another feature of the present invention is the provision in a playyard, of the upper floor extending over the interlocking elements of the outer portion of the quick connect mechanism.

Another feature of the present invention is the provision in a playyard, of the upper floor extending over the outer portion of the quick connect mechanism.

Another feature of the present invention is the provision in a playyard, of the lower floor including a periphery, and where the interlocking elements of the outer portion of the quick connect mechanism are disposed inwardly of the periphery of the lower floor.

Another feature of the present invention is the provision in a playyard, of the interlocking elements of the outer portion of the quick connect mechanism are disposed inwardly of the sidewall.

Another feature of the present invention is the provision in a playyard, of the sidewall and lower floor forming a junction, and where the interlocking elements of the outer portion of the quick connect mechanism are disposed inwardly of the junction of the sidewall and lower floor.

Another feature of the present invention is the provision in a playyard, of the quick connect mechanism including a zipper and the interlocking elements comprise teeth, where the upper floor includes a resilient pad extending between opposing portions of a periphery of the upper floor, and where the resilient pad covers the interlocking elements of the inner portion of the quick connect mechanism.

Another feature of the present invention is the provision in a playyard, of the quick connect mechanism including a zipper and the interlocking elements include teeth, where the upper floor includes a resilient pad extending between opposing portions of a periphery of the upper floor, and where the resilient pad covers the interlocking elements of each of the inner and outer portions of the quick connect mechanism.

Another feature of the present invention is the provision in a playyard, of the quick connect mechanism including a zipper and the interlocking elements include teeth, where the upper floor includes a resilient pad extending between opposing portions of a periphery of the upper floor, and where the resilient pad covers each of the inner and outer portions of the quick connect mechanism.

Another feature of the present invention is the provision in a playyard, of the quick connect mechanism including a zipper and the interlocking elements include teeth, where the upper floor includes a resilient pad extending between opposing portions of a periphery of the upper floor, where the resilient pad covers the interlocking elements of the inner portion of the quick connect mechanism, where the upper floor includes sheeting encapsulating the resilient pad, where the inner portion of the quick connect mechanism is engaged to the sheeting, and where the outer portion of the quick connect mechanism is engaged to the flexible pen.

Another feature of the present invention is the provision in a playyard, of the quick connect mechanism including a zipper and the interlocking elements including teeth, where the upper floor includes a resilient pad extending between opposing portions of a periphery of the upper floor, where the resilient pad covers the interlocking elements of the inner portion of the quick connect mechanism, where the upper floor includes sheeting encapsulating the resilient pad, where the inner portion of the quick connect mechanism is engaged to the sheeting, and where the outer portion of the quick connect mechanism is engaged to the lower floor of the flexible pen.

Another feature of the present invention is the provision in a playyard, of the interlocking elements of the second portion of the quick connect mechanism being spaced from a periphery of the lower floor.

Another feature of the present invention is the provision in a playyard, of the upper floor including an underside, where the inner portion of the quick connect mechanism is disposed adjacent to a periphery of the upper floor on the underside of the upper floor, where the underside of the upper floor is free of quick connect mechanisms disposed inwardly of the inner portion of the quick connect mechanism, and where an upper side of the lower floor is free of quick connect mechanisms disposed inwardly of the outer portion of the quick connect mechanism.

An advantage of the present invention is comfort and safety of children. One feature contributing to this advantage is engagement of the quick connect mechanism to the underside of the upper floor. Another feature contributing to this advantage is the engagement of the quick connect mechanism on the underside of the upper floor at a location spaced from a periphery of the upper floor. Another feature contributing to this advantage is the placement of the outer teeth of the outer portion of the quick connect mechanism at a location disposed inwardly from the sidewall of the flexible pen. These features maximize the chances that, with children playing in the playyard, the upper floor covers the quick connect mechanism.

Another advantage is that the present playyard floor apparatus having the upper and lower floors is easy and inexpensive to manufacture.

Another advantage is that the present playyard apparatus includes no Velcro® material and no Dual Lock™ material. Although the strength of such materials may be varied, any use of such materials likely would involve a disconnect in the vertical direction, and a disconnect in a vertical or oblique direction of two horizontal extending floors may be problematic since one horizontally extending floor must be held while the other horizontally extending floor is pulled off vertically or obliquely.

Another advantage of the present playyard apparatus is that no connect mechanism and no quick connect mechanism is included on the upper floor inwardly of the inner portion of the quick connect mechanism and that no connect mechanism and no quick connect mechanism is included on the lower floor inwardly of the outer portion of the quick connect mechanism. With playyards it may be problematic to bend over the sidewall of the flexible pen and manually grasp central portions of the upper and lower floors.

Another advantage of the present playyard apparatus is that the upper floor is easily removably engaged such that the upper floor can be cleaned and/or washed.

Another advantage of the present playyard apparatus is that the caretaker, in engaging and disengaging the upper floor, manipulates only the portions of the upper floor that are adjacent to the sidewall and thus easily reached.

Another advantage of the present invention is that a zipper slides easily and thus places minimum stress on portions of the playyard, such as fabric portions that may be torn.

Another advantage of the present invention is that a zipper slides silently, whether during an opening or closing of the zipper, and does not generate a ripping or clicking sound during connection and disconnection.

Another advantage of the present invention is that a zipper collects a minimum amount of dirt compared to other quick connect mechanisms such as Velcro® material and Dual Lock™ material.

Another advantage of the present invention is that, with the quick connect hidden from view on the underside of the upper floor and spaced inwardly from the periphery of the upper floor, chances are minimized that a small child playing on the upper floor will locate the quick connect.

DESCRIPTION

Figure 1:
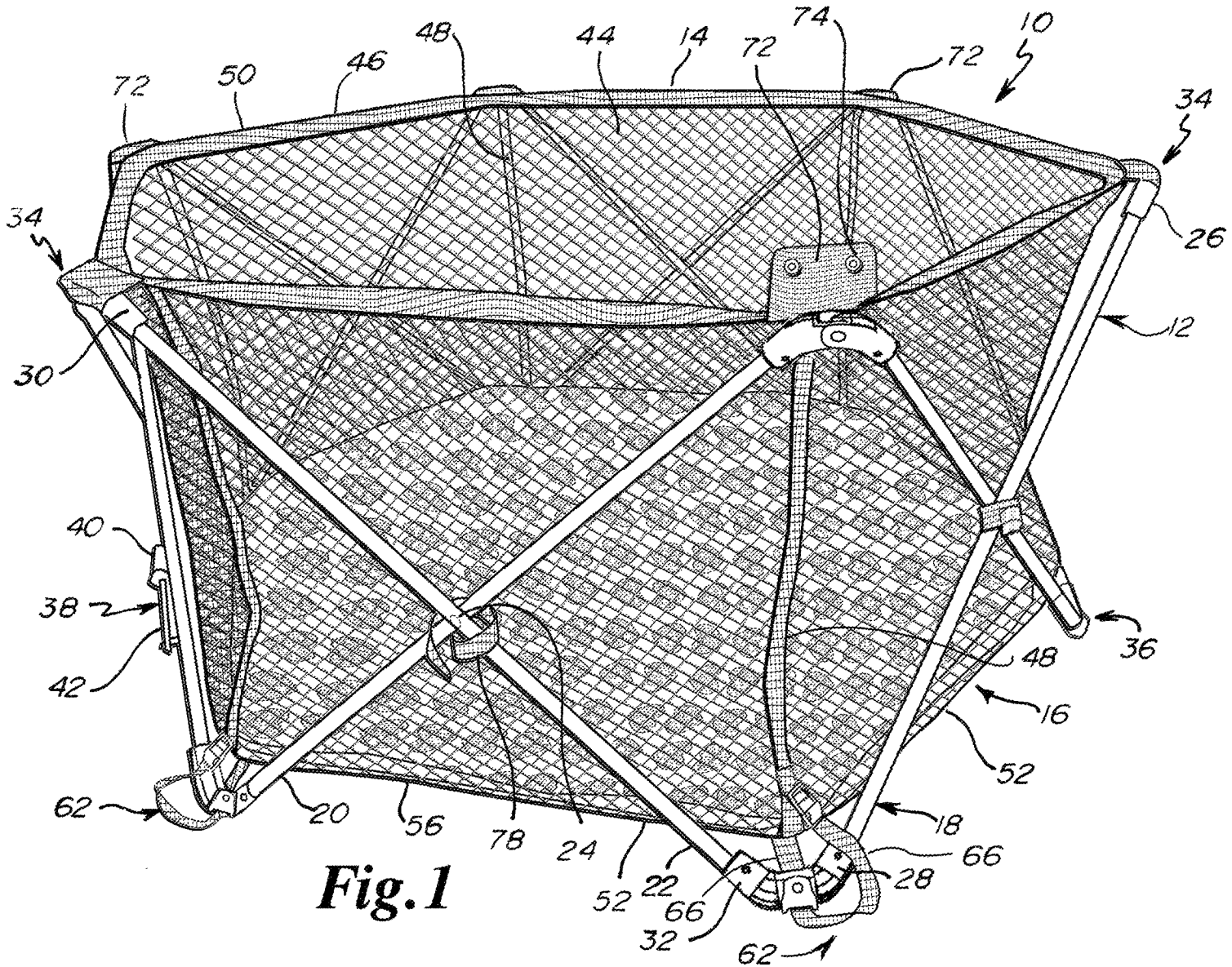
FIG. 1 is a perspective view of the present playyard apparatus having upper and lower floors.

As shown in FIG. 1, the present playyard is indicated by the reference numeral 10. Playyard 10 includes an endless frame 12, an endless sidewall 14, and a playyard floor apparatus 16. The playyard floor apparatus 16 includes a lower floor 54, an upper floor 80, a junction 52, and a zipper mechanism 101 having outer and inner teeth 82, 90 that are spaced inwardly from a periphery 94 of the upper floor 80 such that a cushion 100 of the upper floor 80 covers the outer and inner teeth 82, 90.

Frame 12 is a scissoring folding frame. Frame 12 includes six folding scissoring sections 18. Each of the sections 18 includes a pair of tubular frame members 20, 22 interconnected by a pin connector at an intermediate junction 24. Frame member 20 is adjacent to and spaced from sidewall 14 with no other frame members, including frame member 22, between such frame member 20 and the sidewall 14. The other of the frame members, namely frame member 22, is adjacent to and spaced from the sidewall 14 with frame member 20 being between such frame member 22 and the sidewall 14. Frame section 18 can scissor out to the expanded "X" form shown in FIG. 1 and can scissor in to the retracted "X" form shown in FIG. 13.

Frame member 20 includes an upper end 26 and a lower end 28. Frame member 22 includes an upper end 30 and a lower end 32. Upper end 26 of frame member 20 of one frame section 18 is pivotally engaged at an upper junction 34 to upper end 30 of frame member 22 of an adjacent frame section 18. Lower end 28 of frame member 20 of one frame section 18 is pivotally engaged at a lower junction 36 to lower end 32 of frame member 22 of an adjacent frame section 18.

All of the intermediate junctions 24, upper junctions 34, and lower junctions 36 are free for pivoting at all times except when an over center lock 38 is locked. Over center lock 38 extends between the lower half portions of support members 20 and 22. Over center lock 38 includes a medial lock 40 and elongate members 42 extending from each of the sides of the medial lock 40, where one elongate member 42 extends to the lower half of support member 22 where such elongate member 42 is pivotally engaged, and where the other elongate member extends to the lower half of support member 20 where such elongate member 42 is pivotally engaged. When medial lock 40 is pressed by a foot downwardly, the lower half portions of the support members 20, 22 are pivoted apart and the medial lock 40 passes through an over center mechanism, thereby locking support members 20, 22 into a fixed position, and thereby locking all support members 20, 22 and the entire frame 12 in a fixed position. When the medial lock 40 is raised, such as by a foot, the medial lock 40 passes through an over center position, thereby releasing the support members 20, 22 and the entire frame 12 from such fixed position and into a state where the frame 12 is pivotal or foldable to the compact position shown in FIG. 13.

Endless sidewall 14 is flexible. Endless sidewall 14 may be formed of a fabric material. Endless sidewall 14 may be formed of a mesh material as indicated by reference number 44.

Endless sidewall 14 includes six sidewall sections 46 joined to each other. Section 46 may include peripheral reinforcement material that is not a mesh material such that sidewall 14 may be partially formed of mesh 44 and partially formed of a non-see-through fabric material such as vertical flexible straps 48 and upper horizontal peripheral flexible straps 50. Vertical flexible straps 48 are stitched or engaged vertically between adjacent sections 46 and define the junctions of adjacent sidewall sections 46. Horizontal peripheral flexible strap 50 is an upper horizontally and endlessly extending portion of the sidewall 12. Horizontal peripheral flexible strap 50 forms an upper boundary of each of the sidewall sections 46.

Figure 11:
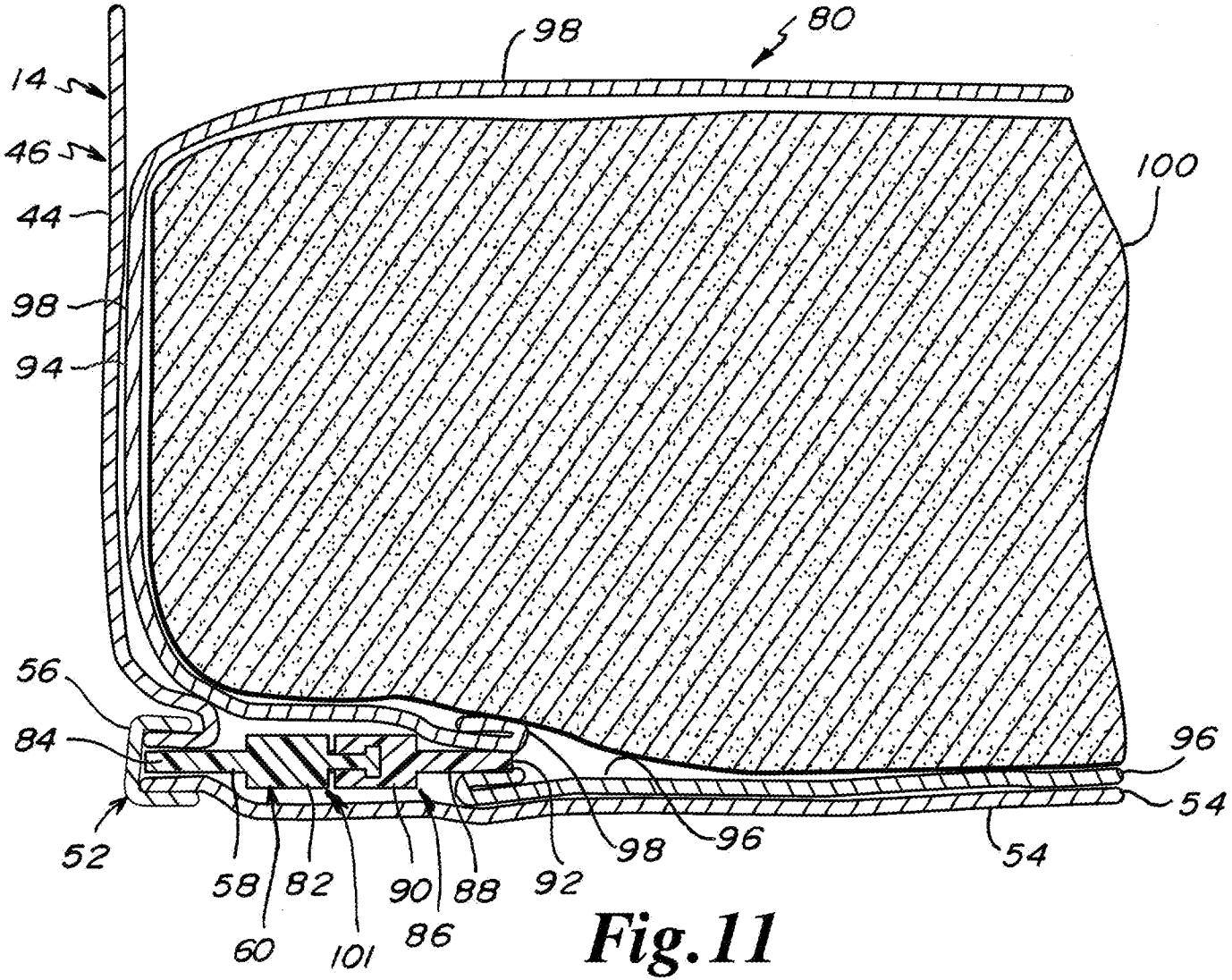
FIG. 11 is a diagrammatic sectional view of the upper floor, lower floor, mesh sidewall, and zipper mechanism of the playyard apparatus of FIG. 1.

Vertical flexible straps 48 run from the upper horizontal peripheral flexible strap 50 to a lower endless fabric junction 52. Junction 52 is a lower junction between sidewall 14, lower floor 54, a lower horizontal peripheral flexible strap 56, and a flexible strip 58 or flexible tape 58 of an outer zipper portion 60. Lower horizontal peripheral flexible strap 56 in section view, as shown in FIG. 11, takes a cap or cap like form or U-shaped form and engages a lower peripheral edge section of mesh 44 of sidewall 14, an outer peripheral edge section of lower floor 54 as well as the flexible strip 58 of the outer zipper portion 60. A disengagement of the lower floor 54 from the sidewall 14 destroys an integrity of the junction 52 between the sidewall 14 and lower floor 54.

Lower floor 54 defines a closed bottom to the playyard 10. Lower floor 54 is opposite of an open top of the playyard 10. Lower floor 54 is hexagonal. Lower floor 54 includes a hexagonal periphery, which periphery is stitched to strip or strap 56. Lower floor 54 is flexible. Lower floor 54 is formed of a fabric or fabric like material. Lower floor 54 is formed of a non-see-through material. Lower floor 54 may be formed of a water-tight or a water-proof material. Lower floor 54 may be formed of a material having pores or spaces that keep out water or moisture in a liquid form but that permit water or moisture in a gas form to pass therethrough. Lower floor 54 may be formed of a material having pores or spaces that permit water or moisture in a liquid or gas form to pass therethrough. Lower floor 54 may be formed of a material having pores or spaces that do not permit the passage of either water or moisture in a liquid or gas form.

Figure 12A:
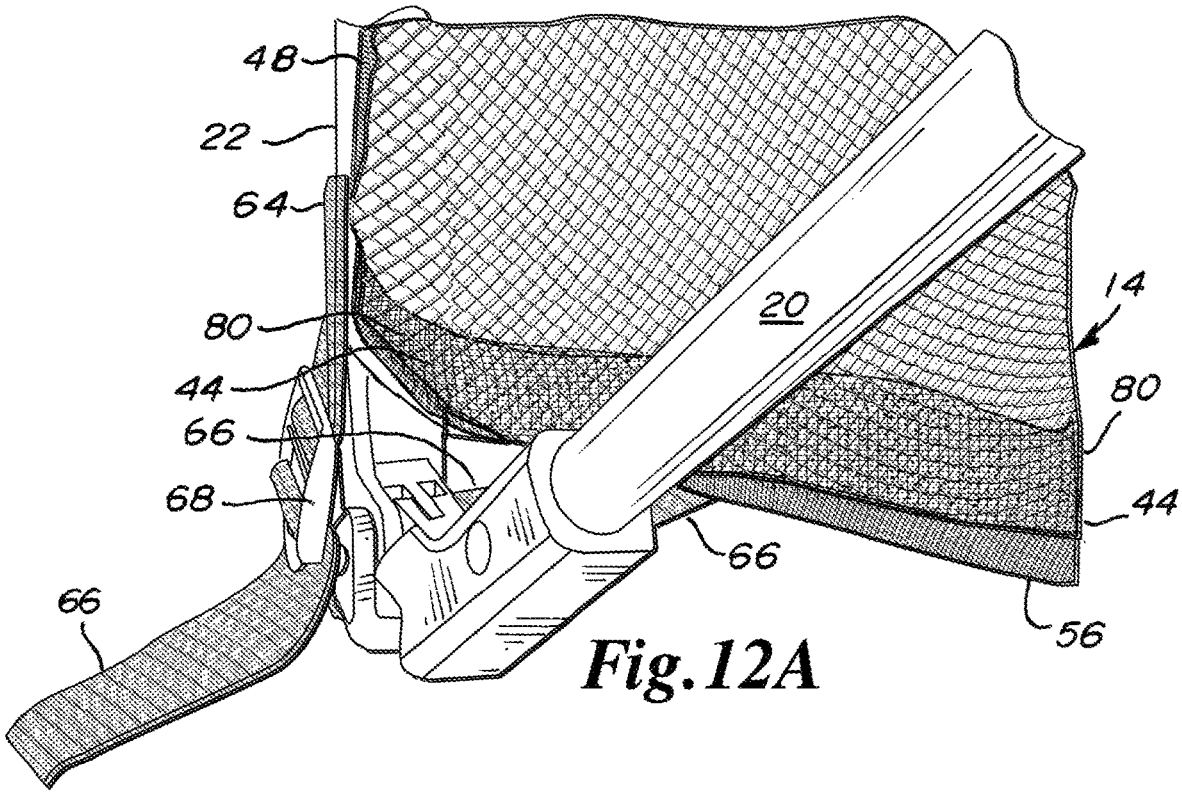
FIG. 12A is a perspective detail view of a first lower junction of the playyard apparatus of FIG. 1.
Figure 12B:
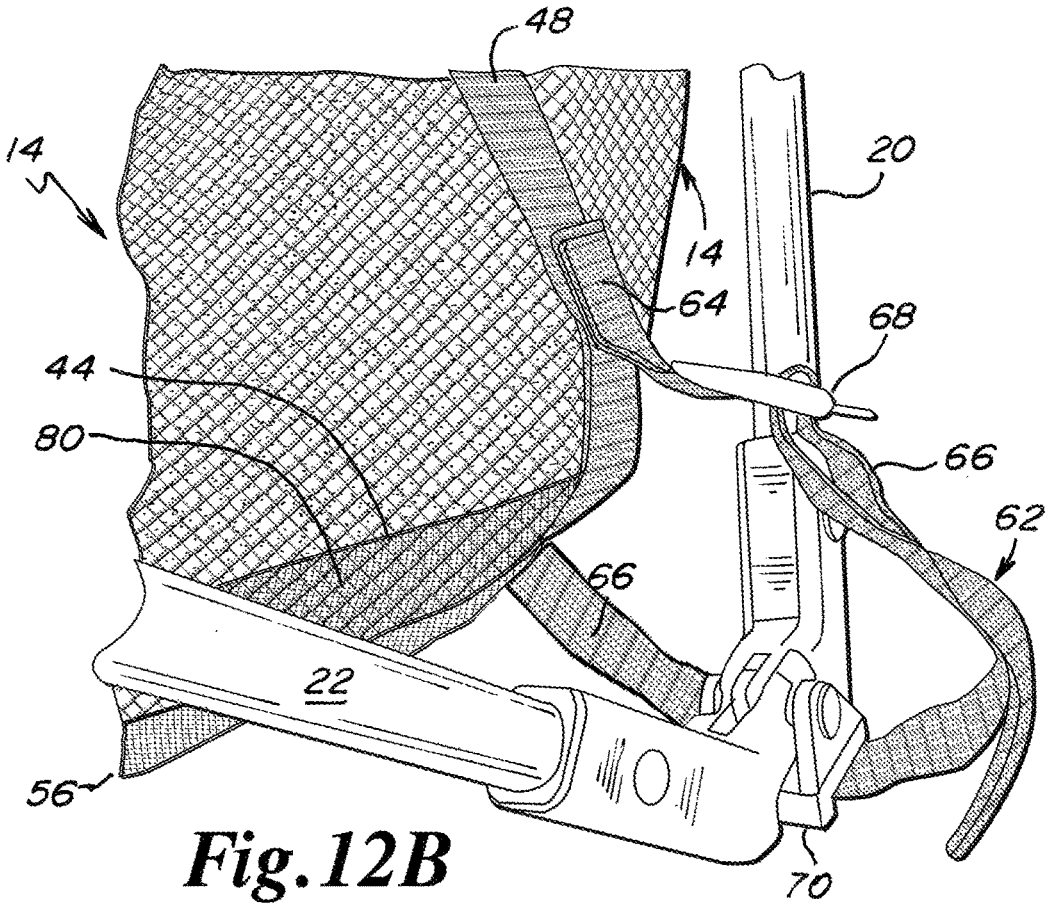
FIG. 12B is a perspective detail view of a second lower junction of the playyard apparatus of FIG. 1.
Figure 13:
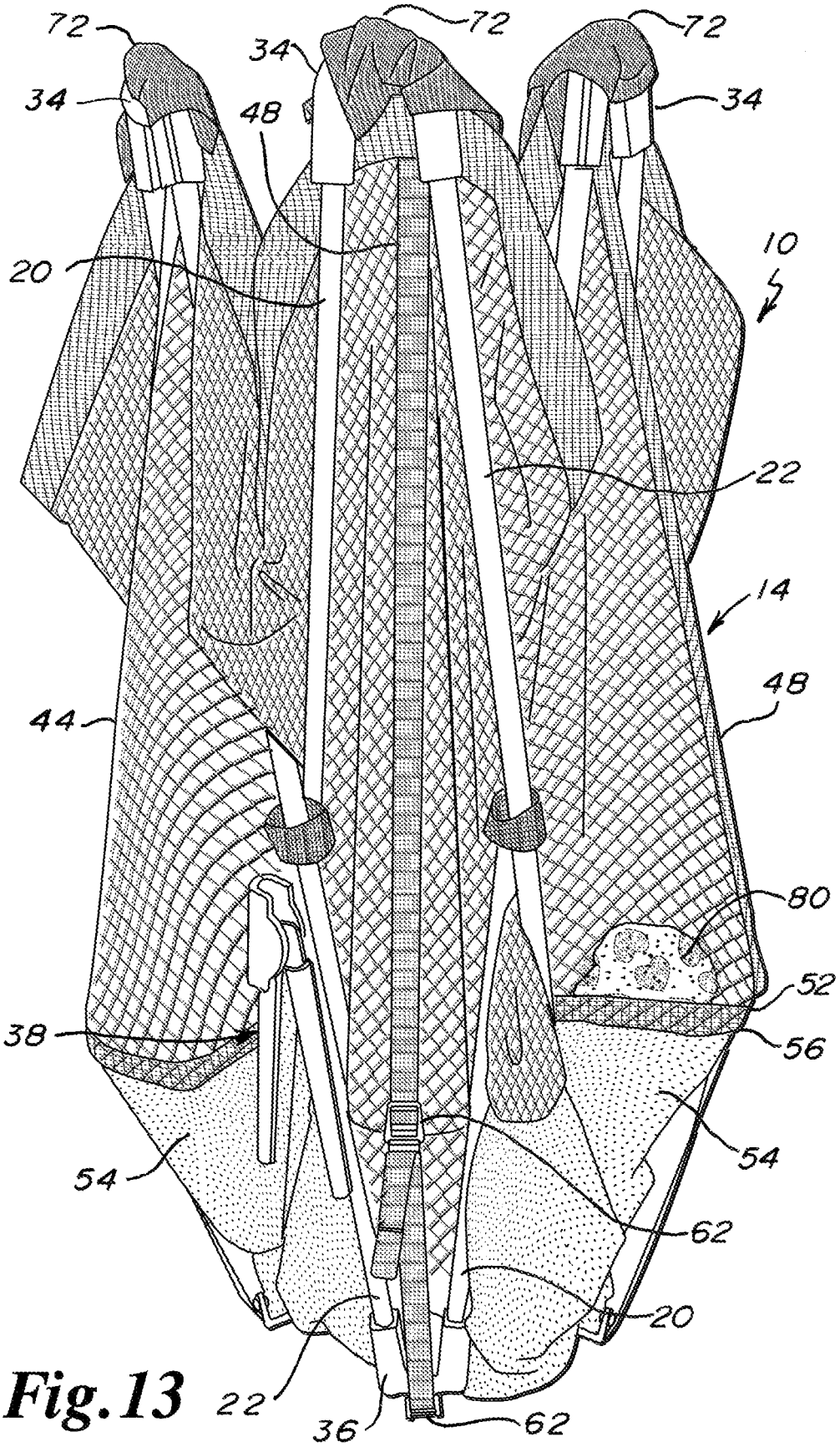
FIG. 13 is a perspective view of the playyard apparatus of FIG. 1 in a compact folded state.

Lower flexible fabric or nylon floor 54 is engaged to the endless sidewall 14 peripherally at the junction 52 that extends endlessly about the playyard 10. Lower flexible floor 54 is further engaged by a set of six strap apparatus 62. As shown in FIG. 12B, strap apparatus 62 includes a short strap 64, a long strap 66, and an adjustable buckle 68 engaged between the short strap 64 and the long strap 66. One end of the short strap 64 is engaged to vertical strap 48. The other end of the short strap 64 is engaged to buckle 68 such as by being looped about an internal post of the buckle 68 and engaged back to itself such that short strap 64 is permanently engaged to buckle 68. Buckle 68 is pivotal relative to short strap 64. One end portion of long strap 66 adjustably engages another internal post of buckle 68. An intermediate portion of long strap 66 is engaged by a pivoting foot 70 that is engaged to the lower junction 36. Pivoting foot 70 includes an inverted U-shaped bottom portion that slidingly engages the intermediate portion of long strap 66. U-shaped bottom portion includes a slot through which the intermediate portion of the long strap 66 passes. After engaging the foot 70, the intermediate portion of long strap 66 extends to the underside of the lower floor 54 where a distal end of the long strap 66 is engaged. The location on the underside of the floor 54 is spaced from endless junction 52 and is further spaced from the center of the floor 54 such that the distal end of the long strap 66 is engaged intermediate of the endless junction 52 and the center of the floor 54. When the playyard 10 is in the operating position shown in FIG. 1 where the frame 12 is scissored apart and locked, the strap apparatus 62 is taut as shown in FIG. 12A. This taut state is also maintained when the playyard is in the collapsed state as shown in FIG. 13. This taut state is not a fully tightened state. This taut state is not a fully loosened state.

Opposite of the strap apparatus 62 and lower junctions 36, the playyard 10 includes the upper junction 34 that are engaged by fabric flexible ears 72. Ears 72 extend from the sidewall 14 and are engaged at six locations to the sidewall 14 and horizontal strap 50. Each of the flexible ears 72 includes a pair of quick connects 74, such as snaps. Flexible ear 72 extends over a top of upper junction 34, then extends over an outer side of upper junction 34, then extends over an under side of upper junction 34, and then extends over an inner side of upper junction 34 where the quick connects 74 engage quick connects disposed on the inner side of upper junction 34.

Strap apparatus 62 and ears 72 are two tie-ins or means of engagement between the flexible pen 76 and the frame 12, where the flexible pen 76 includes the sidewall 14 and the lower floor 54. A third tie-in or means of engagement between the flexible pen 76 and the frame 12 is an intermediate strap 78. Intermediate strap 78 includes a medial portion that is engaged to the sidewall 14 at a location intermediate horizontal upper strap 50 and horizontal lower strap 56, which location is also intermediate vertical straps 48, which location is at or adjacent to a center of sidewall section 46. Intermediate strap 78 includes two end portions. A first end portion includes a first quick connect. A second end portion includes a second quick connect that engages the first quick connect. The first quick connect may be macroscopic loops or hooks such as found in Velcro® material and may be disposed on the outer side of the first end portion. The second quick connect may include the other of macroscopic loops or hooks such as found in Velcro® material and may be disposed on the inner side of the second end portion. After being wrapped about the front of the intermediate junction 24, the quick connect ends of the strap 78 are engaged to each other to engage the sidewall 14 to the intermediate junctions 24.

Figure 2:
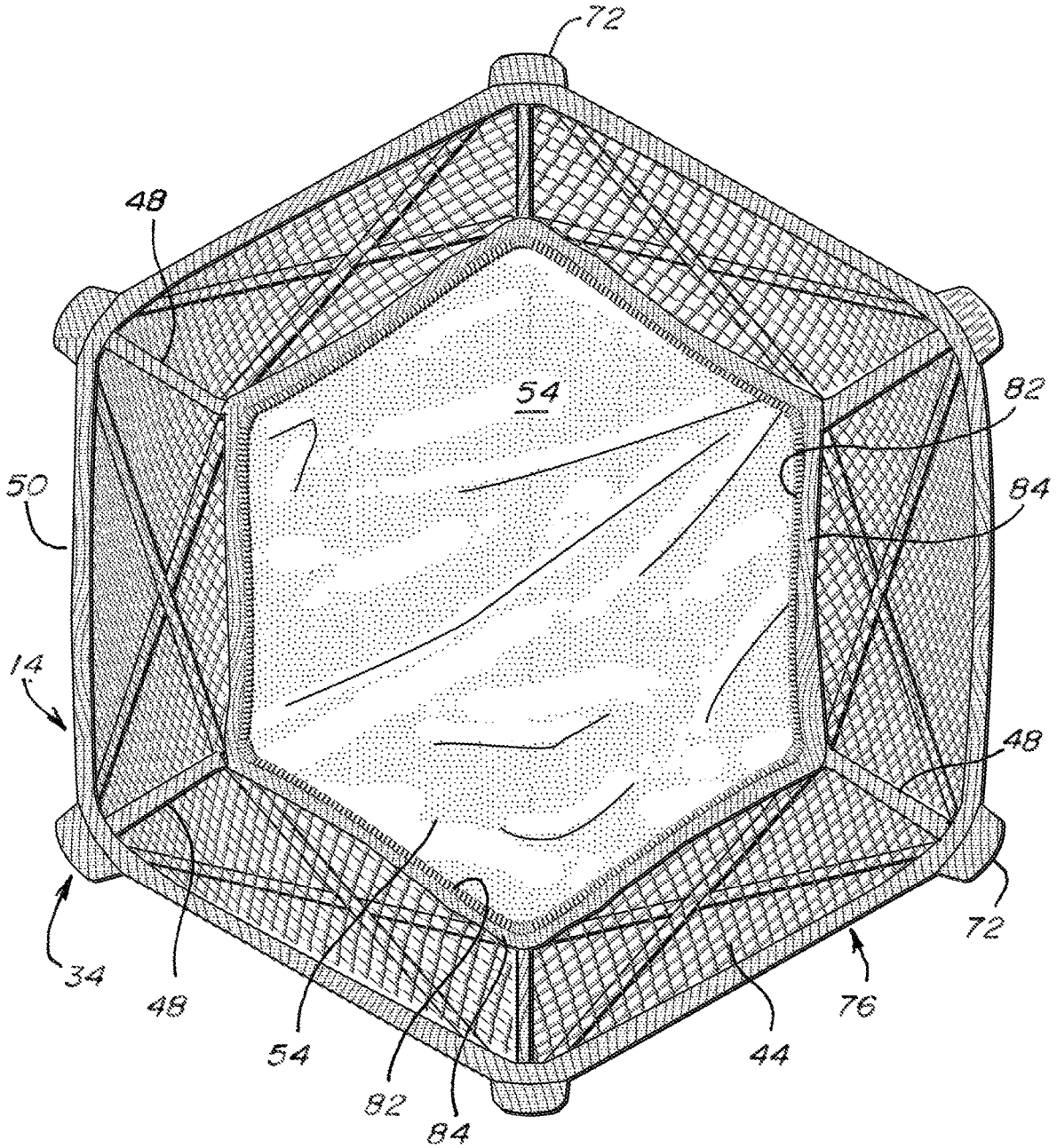
FIG. 2 is a top view of the playyard apparatus of FIG. 1 having the upper floor removed.

FIG. 2 shows a bird's eye view of the playyard 10 without an upper floor 80 engaged. FIG. 2 shows the flexible strip 58 of the outer zipper portion 60. The inner edge portion of the flexible strip 58 includes outer zipper teeth 82. The outer edge portion 84 of the flexible strip 58 is engaged to junction 52. Outer zipper teeth 82 are free floating when the upper floor 80 is not engaged to the playyard 10. The outer zipper teeth 82 float above the lower floor 54 when the upper floor 80 is not engaged to the playyard 10. The lower floor 54 extends under the outer zipper teeth 82 and then extends to the endless junction 52.

Figure 3:
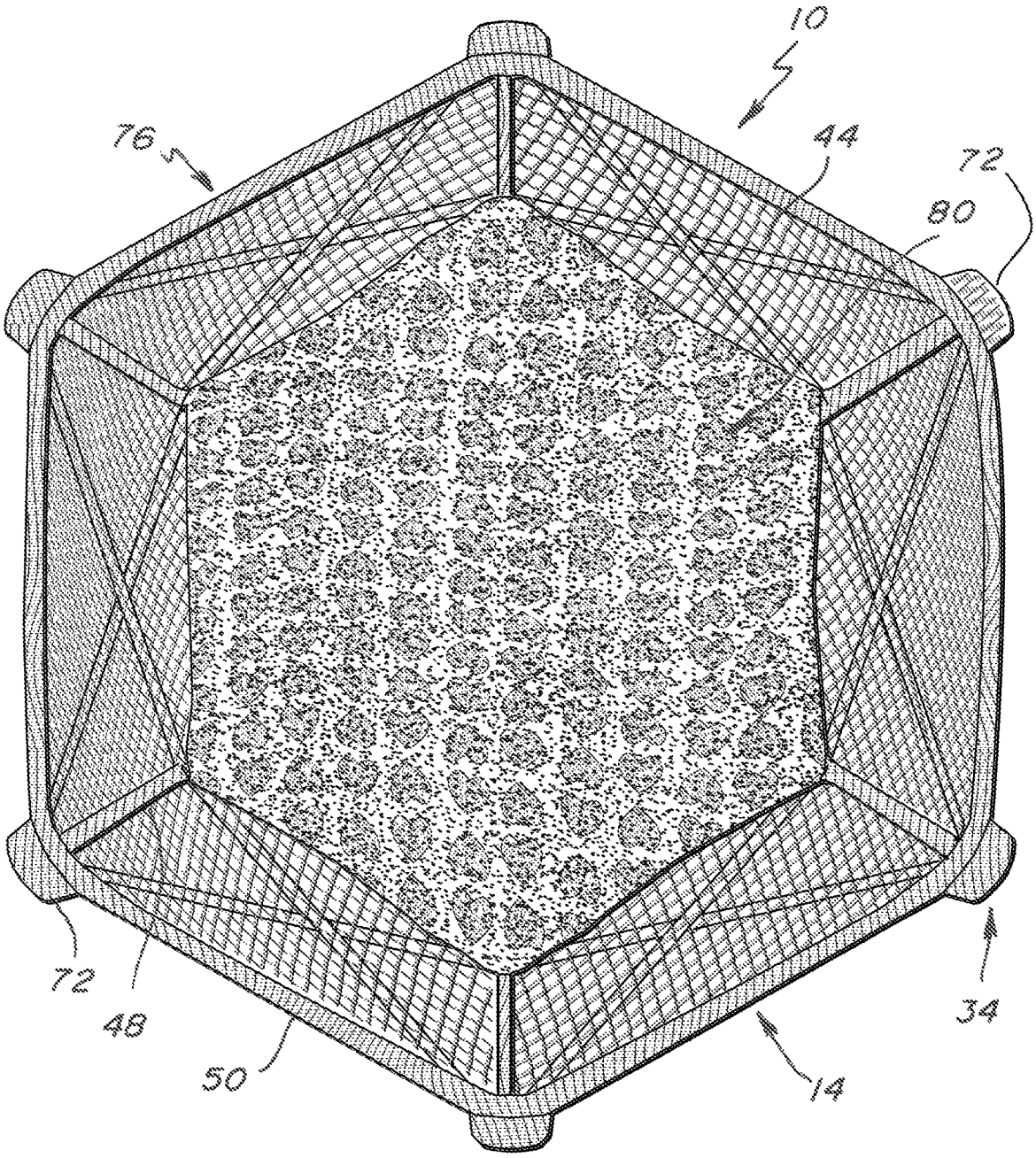
FIG. 3 is a top view of the playyard apparatus of FIG. 1 having the upper floor engaged.

FIG. 3 is a top view or bird's eye view of the playyard 10 with the upper floor 80 engaged. Outer zipper portion 60 including outer strip 58 and outer zipper teeth 82 are not visible because the upper floor 80 extends over such so as to minimize infants, toddlers, and small children from making contact with hard zipper components such as outer zipper teeth 82.

Figure 4:
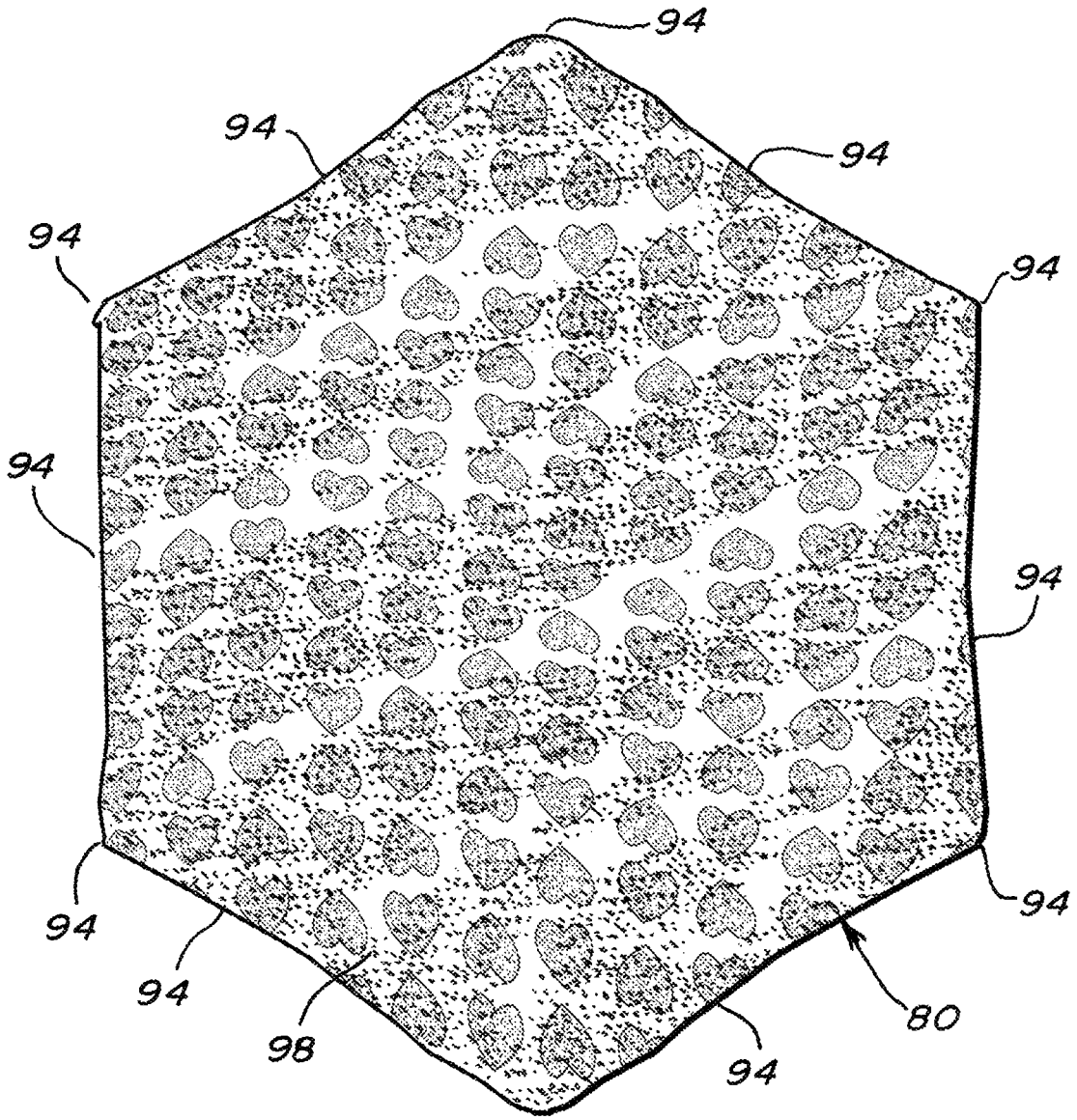
FIG. 4 is a top isolated view of the upper floor of the playyard apparatus of FIG. 1.

FIG. 4 is a top isolated view of the upper floor 80. What is not shown is an inner zipper portion 86 that includes a flexible strip 88 having inner teeth 90 and an inner edge portion 92 because these components are spaced from an outer peripheral edge 94 of the upper floor 80 and are disposed on an underside of the upper floor 80. This outer peripheral edge 94 is adjacent to or confronts or pushes outwardly against the mesh 44 of the sidewall 14 of the playyard 10 so as to minimize infants, toddlers, and small children from coming into contact with hard components such as outer and inner zipper teeth 82, 90.

Figure 5:
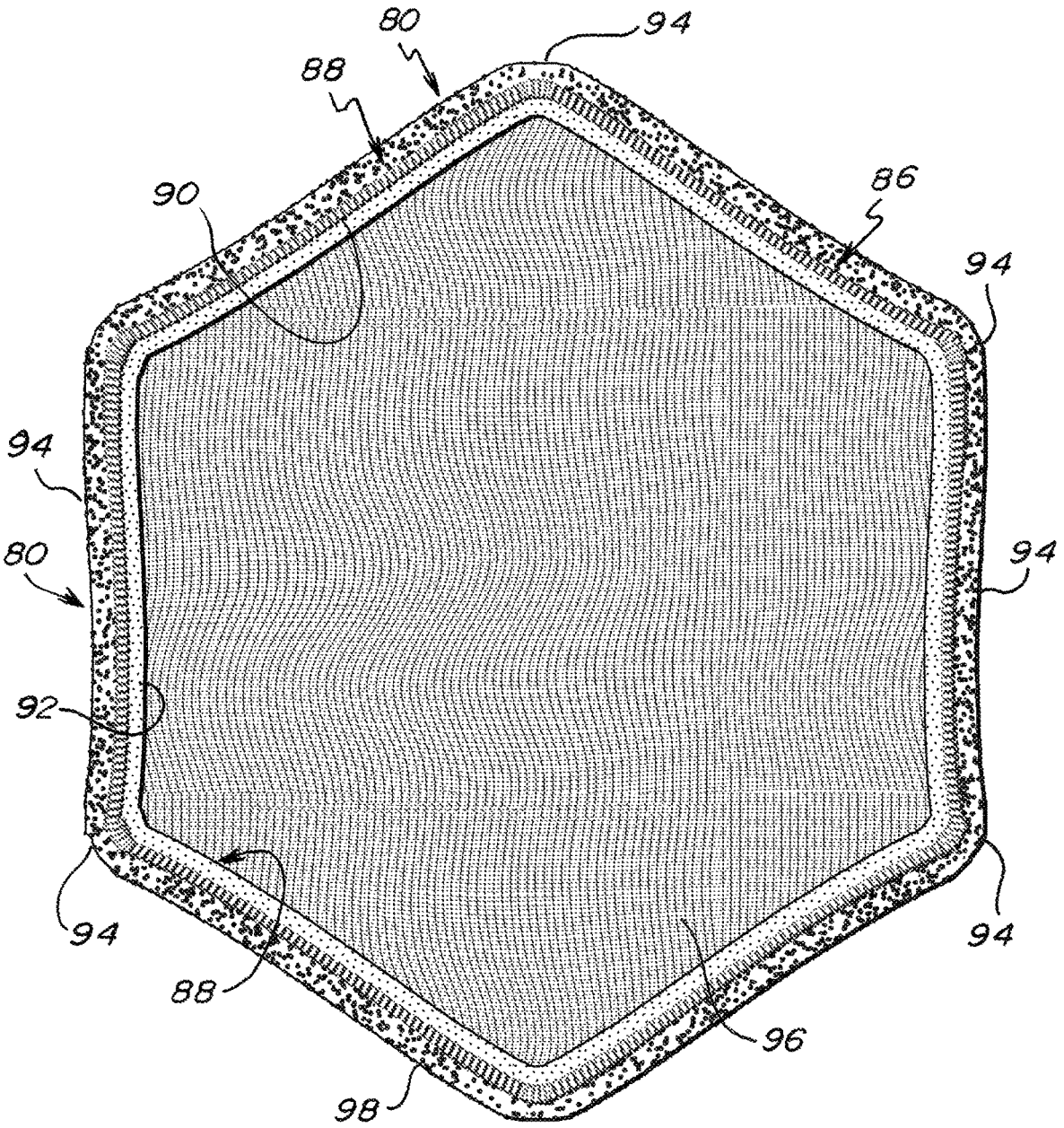
FIG. 5 is a bottom isolated view of the upper floor of FIG. 4.

FIG. 5 is a bottom isolated view of the upper floor 80 such that the underside of the upper floor 80 is shown. FIG. 5 shows the inner zipper portion 86 that includes the flexible strip 88 having inner teeth 90 and inner edge portion 92. Upper floor 80 includes a first sheeting portion 96, a second sheeting portion 98, and resilient cushioning material 100 encapsulated between the first and second sheeting portions 96, 98. The first sheeting portion 96 is disposed inwardly of the inner zipper portion 86 and engaged to the inner edge portion 92 of the flexible strip 88 of the inner zipper portion 86. The second sheeting portion 98 is also engaged to the inner edge portion 92 of the flexible strip 88 of the inner zipper portion 86. Then the second sheeting portion 98 extends over the inner zipper portion 86, then extends over the outer zipper portion 60, then extends upwardly to be adjacent to sidewall 14, and then extends horizontally over the upper side of the resilient cushioned material 100.

Cushion or pad 100 may be an open cell or closed cell foam or other type of resilient material. Cushion 100 may be relatively hard, yet still resilient. Cushion 100 may be relatively soft, yet still resilient. Cushion 100 is preferably formed of a material that does not degrade in residential washing machines and residential dryers. Although a cushion 100 is preferred, sheeting portions 96, 98 may hold therein a hard platform, such as a wood platform. Or, for example, disk shaped upper floor 80 may be inflatable and hold air, and be deflatable. Or, for example, disk shaped upper floor 80 may be fillable with water. With any of such embodiments, the zipper mechanism 101 resides at a location spaced inwardly from a periphery of the upper floor 80.

Figure 6A:
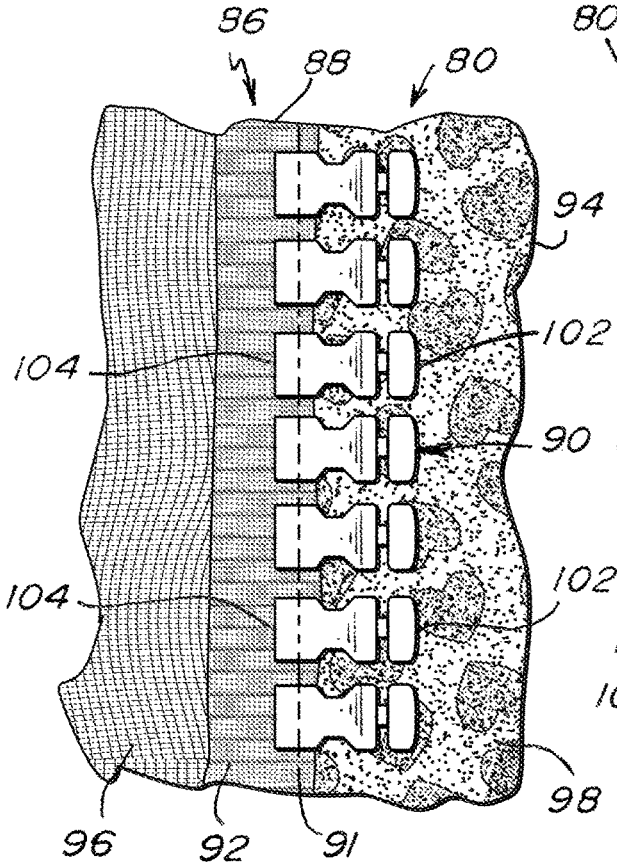
FIG. 6A is a detail view of a portion of FIG. 5, showing the inner side or inner zipper portion of the zipper chain stitched to the underside of the upper floor so as to be spaced from the periphery of the upper floor.

FIG. 6A shows the first zipper chain side 86 or inner zipper portion 86 of the zipper chain 101. Inner zipper portion 86 includes the flexible tape or strip 88. Inner teeth 90 are stitched to an outer edge portion 91 and extend outwardly beyond the outer edge portion 91. An inner edge portion 92 of the flexible strip 88 is stitched to the underside of the upper floor 80 so as to be spaced from the periphery 94 of the upper floor 80. Each inner tooth 90 includes an outer end 102 that is engaged by outer teeth 82 and an inner end 104 that is engaged, such as by being stitched, to the outer edge portion 91 of flexible tape or strip 88. FIG. 6A shows the teeth directed toward the periphery 94, and this is the orientation in which the teeth 90 lie when engaged to the outer teeth 82. However, it should be noted that only one elongate end portion, i.e., the inner edge portion 92 of the flexible tape or strip 88 is engaged to the upper floor 80 such that inner zipper portion 86 is pivotable or swingable relative to the upper floor 80. Inner teeth 90 are set within the periphery 94 and spaced from the periphery 94 when engaged by outer teeth 82.

Figure 6B:
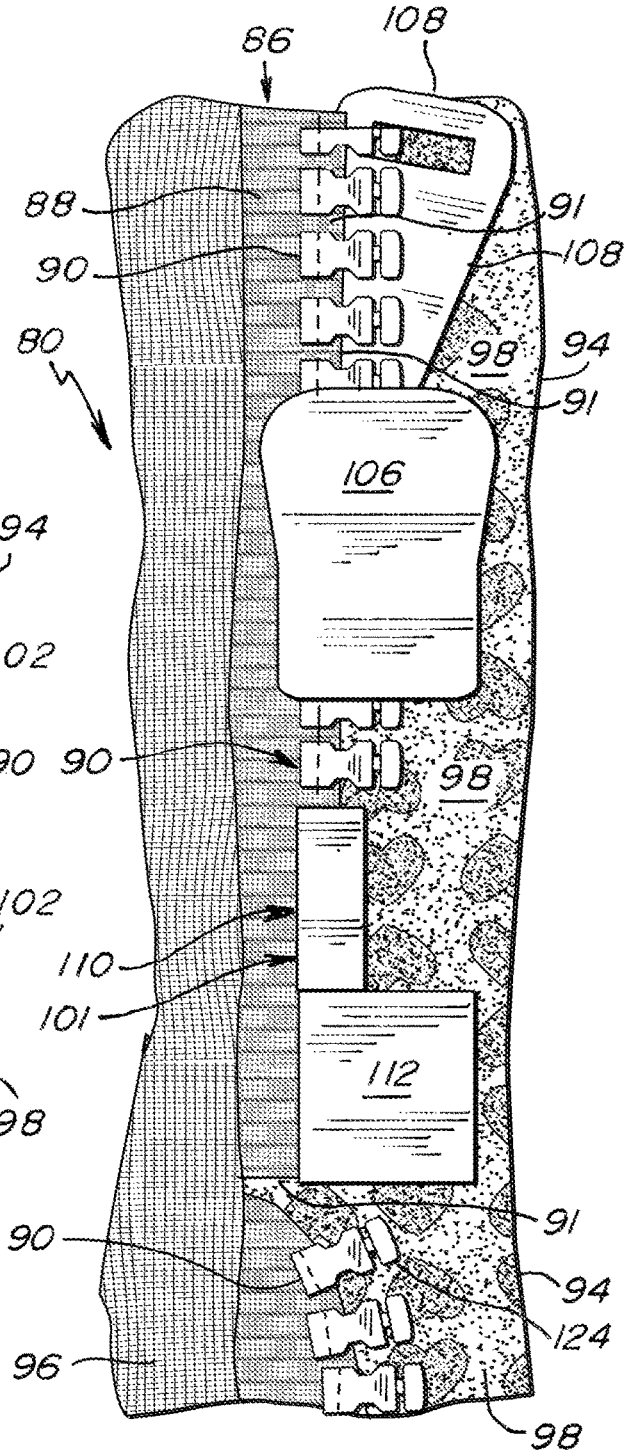
FIG. 6B is a detail view of a portion of FIG. 5, showing the inner side or inner zipper portion of the zipper chain stitched to the underside of the upper floor, where the stitched inner side of the zipper chain is spaced from the periphery of the upper floor, and further showing the pull tab, slider body, retainer box, and first distal stop spaced from the periphery of the upper floor.

FIG. 6B also shows the first zipper chain side 86 or inner zipper portion 86 of the zipper chain 101. Inner zipper portion 86 is engaged, such as by being stitched, to the underside of the upper floor 80. FIG. 6B further shows that the first zipper chain side 86 of the zipper chain 101 is spaced from the periphery 94 of the upper floor 80. FIG. 6B still further shows the slider or slide body 106, the pull tab 108 for pulling the slide body for opening or closing the zipper chain 101, the fixed insertion pin 110, and the retainer box 112 to which the fixed insertion pin 110 is fixedly engaged such as by welding or gluing.

The retainer box 112 and fixed insertion pin 110 are engaged, such as by stitching or gluing, to the outer edge portion 91 of the flexible tape or flexible strip 88. The retainer box 112 also acts as an end stop for the slider 106 after the slider 106 makes its journey around the zipper chain 101 while being spaced inwardly from the periphery 94. It should be noted that the underside of the slider body 106 and pull tab 108 are shown in FIG. 6B. It should be noted that slider body 106, fixed insertion pin 110, retainer box 112 are also disposed within the periphery 94 of the upper floor 80 and are spaced from the periphery 94 of the upper floor 80.

Figure 7A:
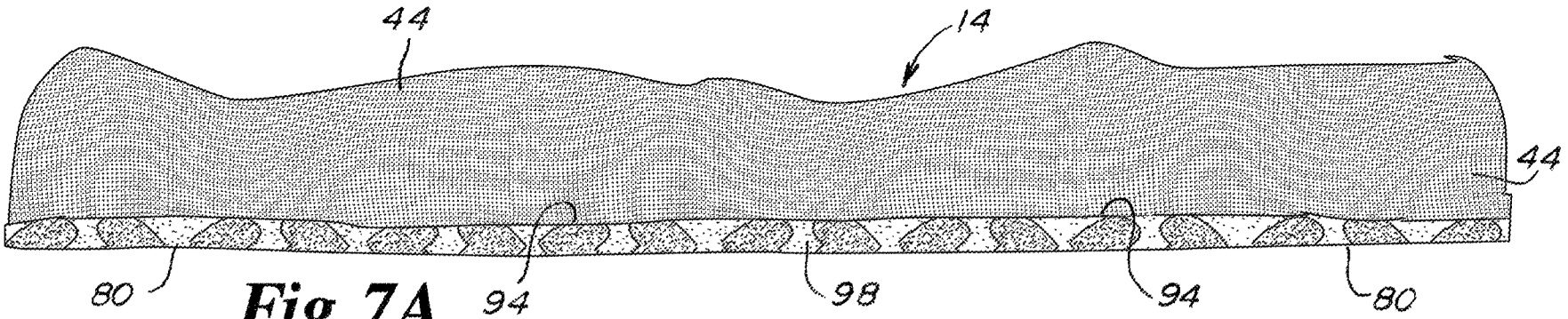
FIG. 7A is an elongated view of a portion of FIG. 3 showing the upper floor engaged over the lower floor, covering the zipper mechanism, and immediately adjacent to the mesh sidewall of the flexible pen of the playyard apparatus.
Figure 7B:
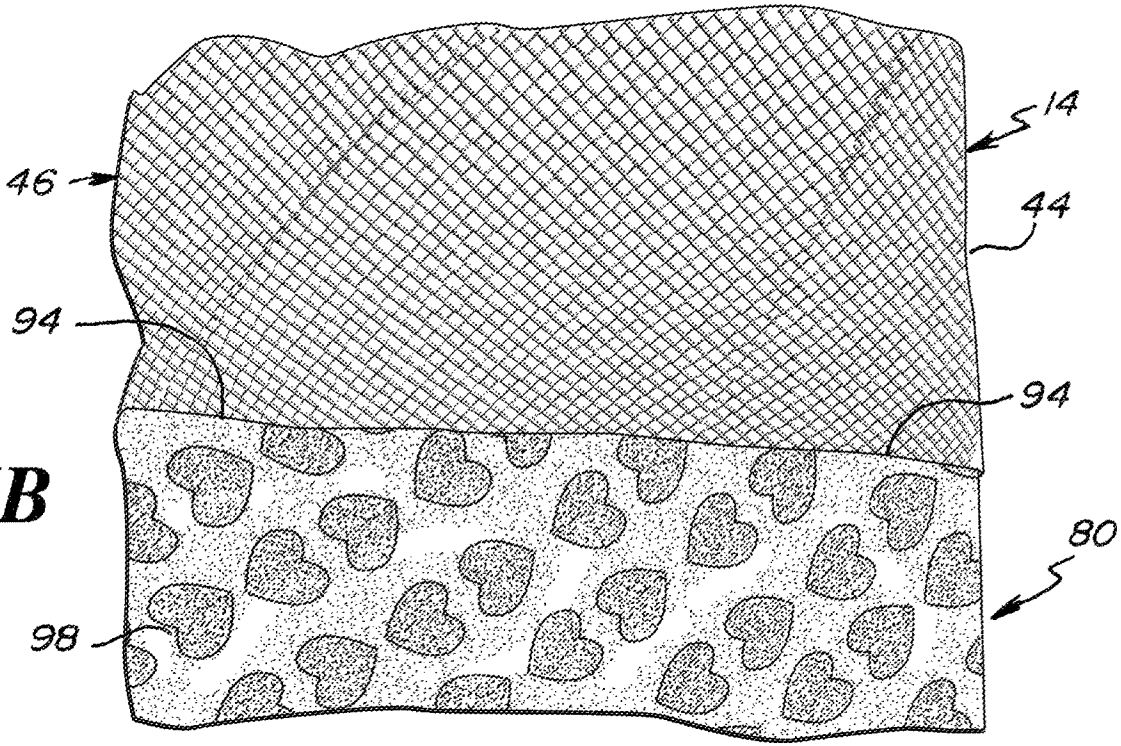
FIG. 7B is an detail view of a portion of FIG. 7A showing the upper floor engaged over the lower floor, covering the zipper mechanism, and immediately adjacent to the mesh sidewall of the flexible pen of the playyard apparatus.

FIG. 7A shows the upper floor 80 engaged over the lower floor 54, covering the zipper mechanism 101, and being immediately adjacent to the mesh sidewall 44 of the flexible pen 76 of the playyard apparatus 10. FIG. 7B is a detail view of a portion of FIG. 7A showing the upper floor 80 engaged over the lower floor 54, covering the zipper mechanism 101, and being immediately adjacent to the mesh sidewall 44 of the flexible pen 76 of the playyard apparatus 10. The zipper mechanism 101 is underneath the upper floor 80 and is not visible when looking down into the flexible pen 76.

Figure 8A:
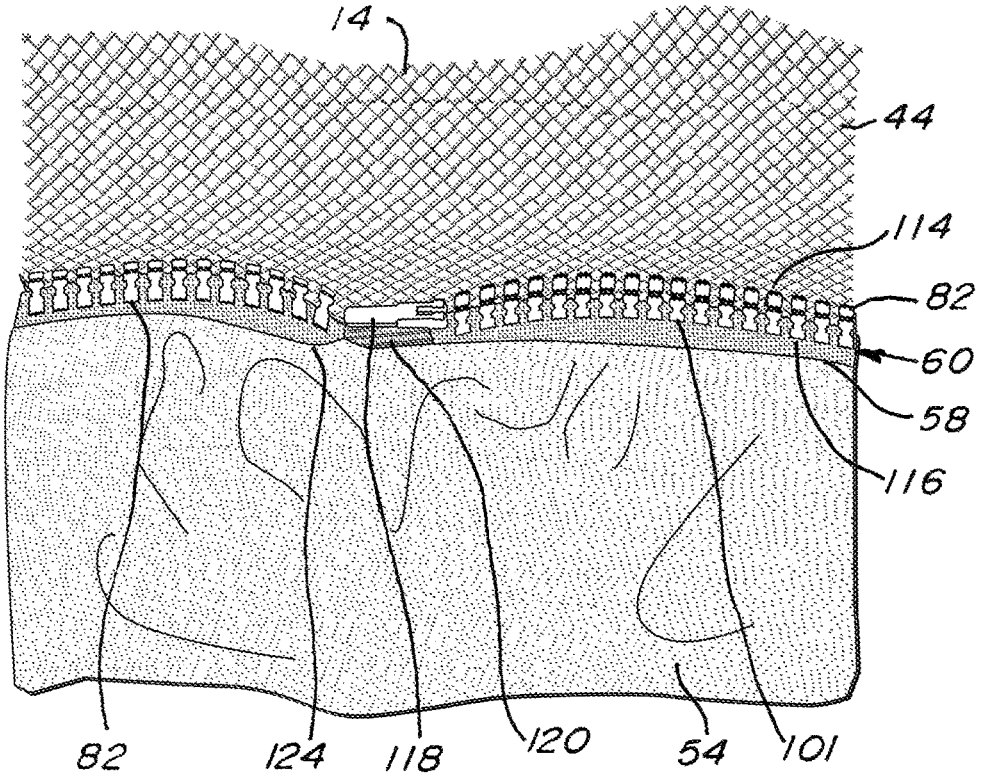
FIG. 8A is a detail view showing the outer zipper portion of FIG. 2, where the outer zipper portion of the zipper chain is adjacent to the junction of the lower floor and the mesh sidewall of the flexible pen, where the outer teeth of the outer zipper portion are spaced inwardly from the mesh sidewall, where the fabric strip or tape of the outer zipper portion is engaged to the junction of the lower floor and the mesh sidewall of the flexible pen, and where the fabric strip or tape of the outer zipper portion is turned upwardly or pivoted upwardly away from the lower floor.
Figure 8B:
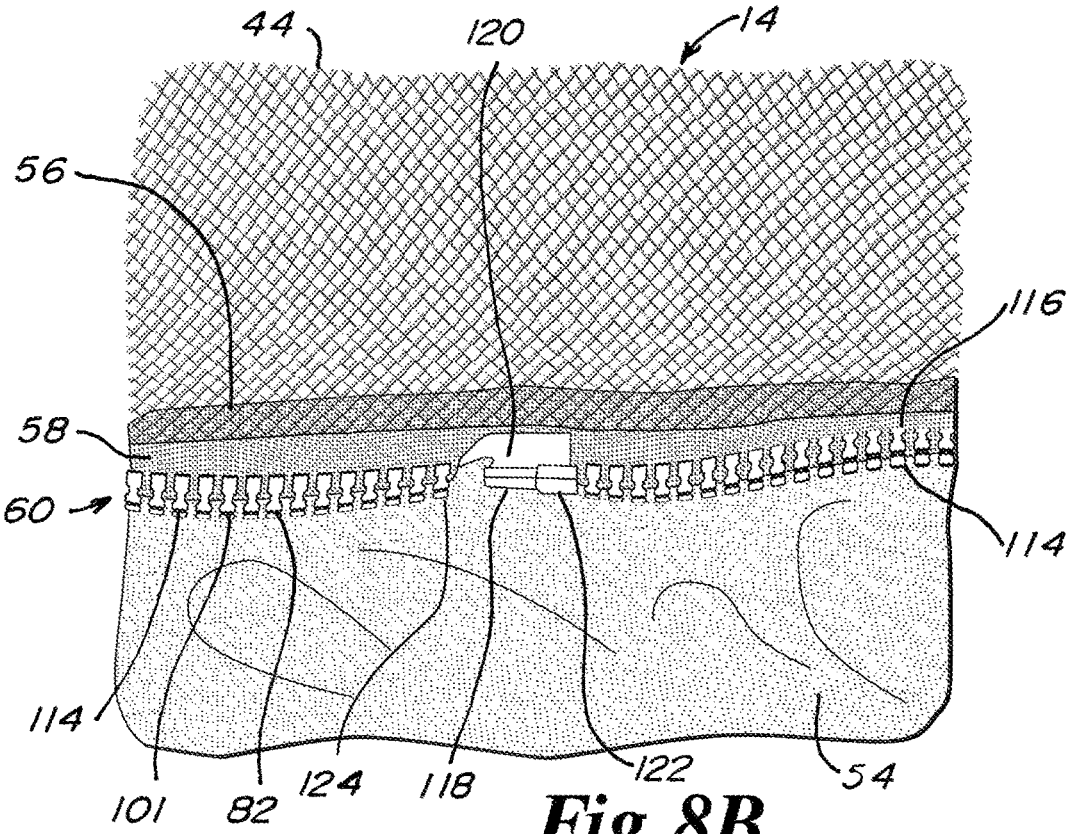
FIG. 8B is a detail view showing the outer zipper portion of FIG. 2, where the outer zipper portion of the zipper chain is adjacent to the junction of the lower floor and the mesh sidewall of the flexible pen, where the outer teeth of the outer zipper portion are spaced inwardly from the mesh sidewall, where the fabric strip or tape of the outer zipper portion is engaged to the junction of the lower floor and the mesh sidewall of the flexible pen, and where the fabric strip or tape of the outer zipper portion is turned downwardly to be adjacent to the lower floor.

FIGS. 8A and 8B show the outer zipper portion 60. In FIG. 8A, the outer zipper portion 60 is pivoted upwardly away from the lower floor 54. In FIG. 8B, the outer zipper portion 60 is pivoted downwardly to be adjacent to the lower floor 54. The outer zipper portion 60 of the zipper chain 101 is adjacent to and engaged to the junction 52 of the lower floor 54 and the mesh sidewall 14 of the flexible pen 76. FIG. 8B shows the position of the outer zipper portion 60 when the lower floor 54 is engaged to the upper floor 80 and here in this position the outer teeth 82 of the outer zipper portion 60 are spaced inwardly from the mesh sidewall 14. The fabric strip 58 or tape 58 of the outer zipper portion 60 is engaged to the junction 52 of the lower floor 54 and the mesh sidewall 14 of the flexible pen 76. As shown in FIG. 8B, outer teeth 82 include an engaging inner end 114 that engage inner teeth 90 and an outer end 116 that is sewn to fabric strip 58. Inner teeth 90 extend inwardly beyond an inner edge portion of fabric strip 58. Outer zipper portion 60 further includes a sliding insertion pin 118 that is slidingly inserted into the throat or front of the slider 106 and then engages an opening in retainer box 112 at location adjacent to and parallel to fixed insertion pin 110. Reference number 120 shows a reinforcing layer of fabric for the fabric strip 58. Reinforcing layer 120 is adjacent to sliding insertion pin 118 that may suffer repeated forces and manipulation over the years. Sliding insertion pin 118 includes a slightly enlarged front portion 122 that may work as a stop after the sliding insertion pin 118 slides a predetermined distance into the retainer box 112. Reference number 124 indicates the end of the zipper chain 101 where the slider 106 ends its journey about the zipper chain 101. The retainer box 112 stops the slider 106 before the slider derails from the zipper teeth 82, 90.

Figure 9A:
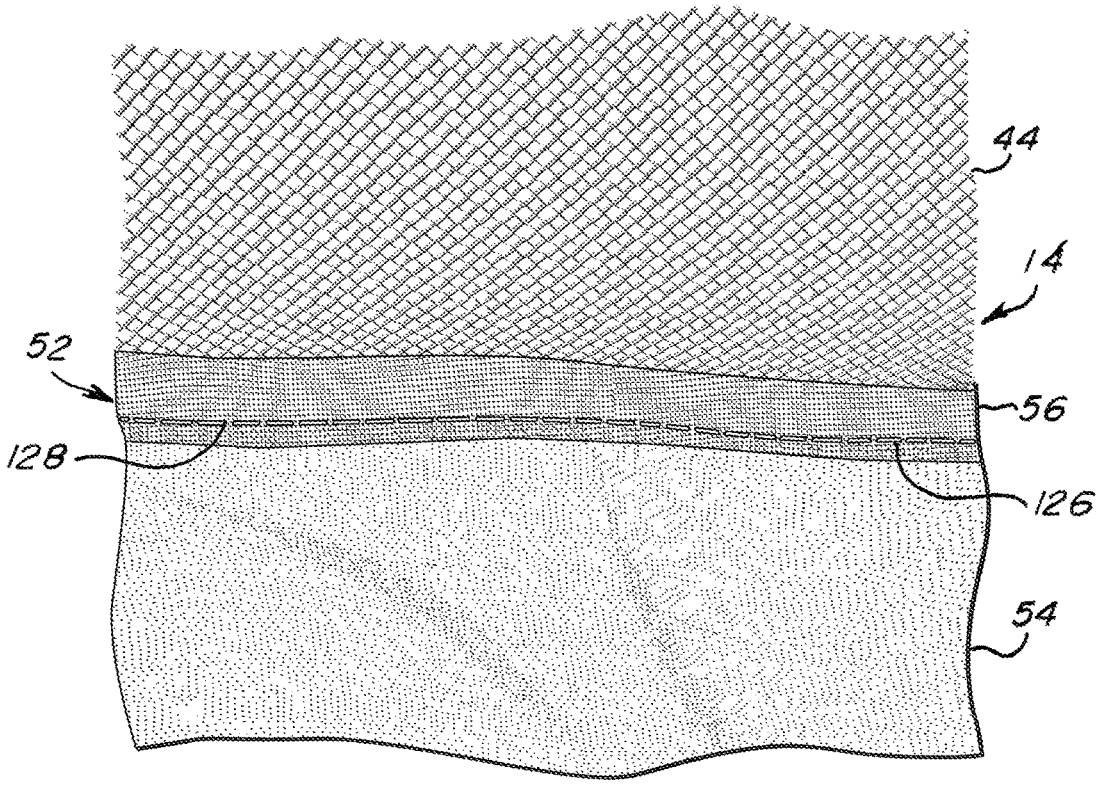
FIG. 9A is a detail side view of the playyard apparatus of FIG. 1 from outside of the playyard apparatus, where the viewer is looking obliquely upwardly at the lower floor and mesh sidewall junction.
Figure 9B:
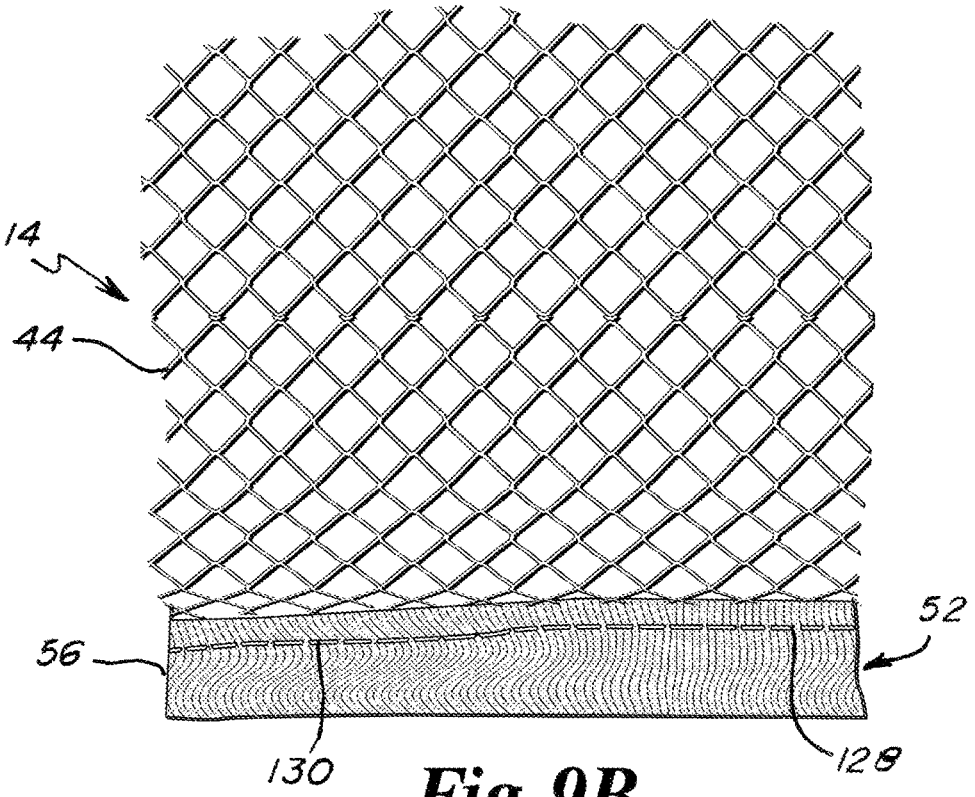
FIG. 9B is a detail side view of the playyard apparatus of FIG. 1 from outside of the playyard apparatus, where the viewer is looking obliquely downwardly at the lower floor and mesh sidewall junction.

FIG. 9A is a detail side view of the playyard apparatus 10 from outside of the playyard apparatus 10, where the viewer is looking obliquely upwardly at the lower floor and mesh sidewall junction 52. FIG. 9B is a detail side view of the playyard apparatus 10 from outside of the playyard apparatus 10, where the viewer is looking obliquely downwardly at the lower floor and mesh sidewall junction 52. Lower horizontal strap 56 works essentially as a cap that pinches a lower edge portion of mesh 44, an outer edge portion of lower floor 54, and the outer edge portion 84 of the outer zipper portion 60. In FIG. 9A, reference number 126 represents the lower side of stitching 128 where the lower side of the lower strap or cap 56 is shown. In FIG. 9B, reference number 130 indicates the upper side of stitching 128 where the upper side of lower strap or cap 56 is shown.

Figure 10:
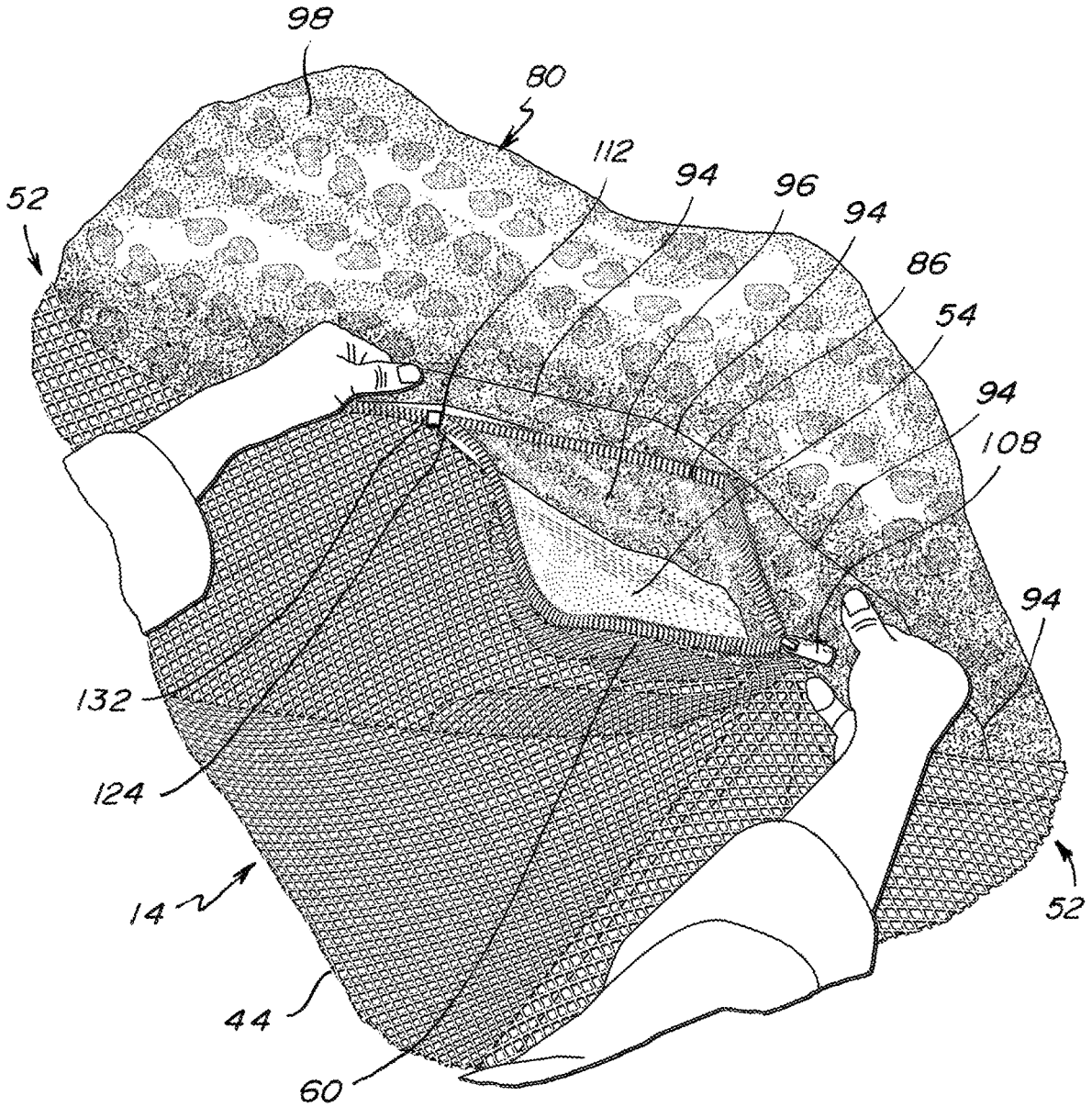
FIG. 10 is a view from the perspective of a caretaker bending over the mesh sidewall of the playyard apparatus of FIG. 1 and shows the inner and outer zipper portions partially unzipped.

FIG. 10 is a view from the perspective of a caretaker bending over the mesh sidewall of the playyard apparatus 10. Reference number 132 indicates the start of the zipper chain 101 at the retainer box 112. From the start 132, the slider 106 draws outer and inner zipper portions 60, 86 together about the underside of the upper floor 80 to the position where the pull tab 108 is shown in FIG. 10. From such position, to complete the zippered engagement between the outer and inner zipper portions 60, 86, the pull tab 108 pulls the slider 106 to draw closed the diamond shaped opening, and then the slider 106 completes its journey at the opposite end of the retainer box 112 from which the slider 106 started its journey. Through the diamond shaped opening, lower floor 54 and lower sheeting 96 of the upper floor 80 can be seen.

FIG. 11 is a diagrammatic sectional view of the upper floor 80, lower floor 54, mesh sidewall 14, and zipper mechanism 101 of the playyard apparatus 10. FIG. 11 further shows the resilient cushion 100. Resilient cushion 100 is encapsulated by sheeting portions 96, 98 to make up the upper floor 80. Upper floor 80, including cushion 100, extends over the zipper mechanism 101 when the playyard apparatus 10 is in the open and operating position shown in FIGS. 1 and 3. The breadth or width of the cushion 100 is sufficiently great a) so as to extend over the inner edge portion 92 of the inner zipper portion 86, b) so as to extend over the inner strip or tape 88 of the inner zipper portion 86, c) so as to extend over the teeth 90 of the inner zipper portion 86, d) so as to extend over the teeth 82 of the outer zipper portion, e) so as to extend over the outer strip or tape 58 of the outer zipper portion 60, f) so as to extend over the outer edge portion 84 of the outer zipper portion 60, g) so as to extend immediately to the inner face of the sidewall 14, h) so as to make contact with the inner face of the sidewall 14, and i) so as to, if desired, push outwardly against the mesh 44 of the sidewall 13. Zipper teeth 82, 90 are disposed between the lower floor 54 and the upper floor 80. Zipper teeth 82, 90 are disposed between the lower floor 54 and the sheeting 98 of the upper floor 80. Sheeting 98 extends from a lower face of cushion 100, to an outer side face of cushion 100, and to an upper face of cushion 100. A sheeting edge portion of sheeting 96 is engaged, such as by stitching, to outer edge portion 92 of inner zipper portion 86, which in turn is engaged, such as by stitching, to sheeting edge portion of sheeting 98. Outer edge portion 84 of outer zipper portion 60 is engaged, such as by stitching, to the lower edge of mesh sidewall 14 and to the outer edge of lower floor 54, and to lower horizontal strap 56 which is disposed in a cap like form to pinch together the lower edge of mesh sidewall 14, outer edge portion of lower floor 54, and outer edge portion 84 of outer zipper portion 60, all of which are engaged to each other such as by stitching.

FIG. 12A is a perspective detail view of a first lower junction 36 of the playyard apparatus 10. FIG. 12B is a perspective detail view of a second lower junction 36 of the playyard apparatus 10. Each of FIGS. 12A and 12B show the upper floor 80 having cushion 100 against the inner face of mesh 44 of mesh sidewall 14.

FIG. 13 is a perspective view of the playyard apparatus 10 in a compact folded state. Relative to the open and operating state shown in FIG. 1, the playyard apparatus 10 is foldable by first releasing the over-center lock 38 by pushing up, such as with one's foot, the medial lock 40 through the over-center position such that the elongate members 42 pivot relative to the medial lock 40 and relative to the support members 20, 22 to which the elongate members 42 are pivotally connected. As such release and pivoting takes place, the frame 12 as a whole may start to scissor closed such that intermediate junctions 24, upper junctions 34, and lower junctions 36 start to pivot. Neither the strap apparatus 62 at the lower junctions 36, nor the straps 78 about the intermediate junctions 24, nor the ears 72 about the upper junctions 34, need to be loosened or released to fold the playyard apparatus 10 from the open and operating state shown in FIG. 1 to the compact state shown in FIG. 13. Nor does the upper floor 80 need to be disengaged from the lower floor 54 for the playyard apparatus 10 to be folded from the open and operating state shown in FIG. 1 to the compact state shown in FIG. 13.

In operation, to unzip or disengage the upper floor 80 from the playyard apparatus 10, the peripheral edge 94 of the upper floor 80 is lifted up to expose to view the slider 106 and pull tab 108. The upper sheeting 98 of the upper floor 80 may be marked with indicia such as "zipper pull tab here" or "zipper here" so that the caretaker may immediately find the slider 106 and pull tab 108. Or the inner or outer face of the sidewall 14 may be marked with such indicia. After the slider 106 is located, the pull tab 108 is pulled and the caretaker 1) walks around the outside of the playyard apparatus 10 while pulling the pull tab 108, or 2) rotates the playyard apparatus 10 while pulling the pull tab 108 and while standing in place, or 3) a combination of such walking and rotating. At location 132, which is immediately forwardly of the retainer box 112, the outer zipper portion 60 disengages from the inner zipper portion 86, whereupon the upper floor 80, having cushion 100 therein, disengages from the lower floor 54 and sidewall 12. Upper floor 80 may then be cleaned such as by being wiped clean or by being deposited in a washing machine. Cushion 100 is preferably not removed from sheeting portions 96, 98 during such cleaning or washing.

In operation, to engage the upper floor 80 to the lower floor 54, the outer and inner zipper portions 60, 82 are engaged. This starts by sliding the slider 106 to the retainer box 112. Then the sliding insertion pin 118 on the outer zipper portion 60 is pushed into the front or throat of the slider 106 and then pushed into the retainer box 112 next to the fixed insertion pin 110 of the inner zipper portion 86. Then the caretaker pulls the pull tab 108 to pull the slider 106 to engage the teeth 82, 90. The caretaker pulls the pull tab 108 so as to engage the outer and inner zipper portions 60, 86 from the front of retainer box 112, about the underside of the upper floor 80, and back to the retainer box 112, albeit to the rear of the retainer box 112. The caretaker does this by 1) walking around the outside of the playyard apparatus 10 while pulling the pull tab 108, or 2) rotating the playyard apparatus 10 while pulling the pull tab 108 and while standing in place, or 3) a combination of such walking and rotating.

The playyard floor apparatus 16 includes one or more of the upper floor 80, the lower floor 54, the junction 52, cushion 100, sheeting 96, sheeting 98, and the zipper mechanism 101 including the outer zipper portion 60, outer tape or flexible strip 58, the inner zipper portion 86, the inner tape of flexible strip 88, the outer teeth 82, the inner teeth 90, the slider 106, pull tab 108 fixed insertion pin 110, retainer box 112, and sliding insertion pin 118. The upper floor 80 is preferably engaged to and disengaged from lower floor 54 when the playyard apparatus 10 is in the open and operating state shown in FIG. 1. However, the upper floor 80 may be engaged to and disengaged from the outer zipper portion 60 (i.e., the lower floor 54 or sidewall 12 or junction 52) when the playyard apparatus 10 is in the compact state shown in FIG. 13, in the open and operating state shown in FIG. 1, or in any state therebetween.

When the upper floor 80 is engaged to the outer zipper portion 60 and the playyard apparatus 10 is in the open and operating position, the upper floor 80 covers the zipper mechanism 101 such that infants, toddlers, and small children are shielded from contact with the zipper mechanism 101 including hard components thereof. To further minimize contact by infants, toddlers, and small children, the periphery or outer edge of the upper floor 80 is immediately adjacent to the inner face of the sidewall 14. If desired, the upper floor 80 may be of a size where the periphery 94 extends beyond the junction 52 such that the upper floor 80 pushes the flexible mesh sidewall 14 outwardly.

Instead of the quick connect zipper mechanism 101 and its outer and inner interlocking zipper portions 60, 86, other quick connect mechanisms may be employed. For example, elongate strips of Velcro® quick connect material or elongate strips of the 3M™ Dual Lock™ quick connect material may be used. One elongate strip may be disposed where outer zipper portion 60 is disposed. The other elongate strip may be disposed where inner zipper portion 86 is disposed. Velcro® material includes hooks on one connector portion and loops on the other connector portion that interlock with each other. The 3M™ Dual Lock™ material is a re-closeable fastener and a quick connect. One connector portion of the Dual Lock™ material includes mushroom shaped heads. The other connector portion of the Dual Lock™ material also includes mushroom shaped heads. The opposing mushroom shaped heads interlock with each other. As to Velcro® material, the Mestral U.S. Pat. No. 3,009,235 issued Nov. 21, 1961 and entitled Separable Fastening Device is hereby incorporated by reference in its entirety. Further as to Velcro® material, the Billarant U.S. Pat. No. 3,417,440 issued Dec. 24, 1968 and entitled Hook And Loop Fastener is hereby incorporated by reference in its entirety. As to the 3M™ Dual Lock™ material, the Melbye et al. U.S. Pat. No. 7,188,396 issued Mar. 13, 2007 and entitled Method For Making A Mushroom-Type Hook Strip For A Mechanical Fastener is hereby incorporated by reference in its entirety.

The upper floor 80 includes an underside that confronts the lower floor 54. The inner zipper portion 86 of the quick connect zipper mechanism 101 is disposed adjacent to and spaced from a periphery 94 of the upper floor 80 on the underside of the upper floor 80. The underside of the upper floor 80 is free of quick connect mechanisms disposed inwardly of the inner zipper portion 86 of the quick connect zipper mechanism 101. The upper side of the lower floor 54 is also free of quick connect mechanisms disposed inwardly of the outer zipper portion 60 of the quick connect zipper mechanism 101.

It should be noted that it is preferred to have both the upper floor 80 and the lower floor 54. However, if desired, the playyard 10 may have only the upper floor 80. In such an embodiment, the lower fabric junction 52 includes the lower endless edge of the mesh 44 of the endless sidewall 14 and the outer strip 58 of the outer zipper portion 60, including the outer edge portion 84. Further in such embodiment, the distal end of long strap 66 engages the lower fabric junction 52 instead of the lower floor 54 (that is not present in this embodiment). Since the lower fabric junction 52 is also engaged to the outer zipper portion 60 that engages the upper floor 80, the long strap 66 pulls out the upper floor 80 when the long strap 66 is tightened or when the playyard 10 is expanded from the collapsed form to the open and operating form. Thus, in such embodiment, the endless lower strap 56 works as a cap for junction 52 and engages the outer zipper portion 60 substantially endlessly, the lower edge of the mesh 44 of the endless sidewall 14 endlessly and, at six spaced apart locations, six distal end portions of six long straps 66. If desired, the distal ends of the long strap 66 may be removably engaged, such as with quick connects, to the underside of the upper floor 80 (and not to the junction 52), which quick connects can be engaged and disengaged with the upper floor 80 when the upper floor 80 is engaged to and disengaged from the playyard 10.

The Flannery et al. U.S. Pat. No. 10,194,755 B1 issued Feb. 5, 2019 and entitled Playyard is hereby incorporated by reference in its entirety into this application.

The Flannery et al. U.S. Pat. No. 10,448,752 B1 issued Oct. 22, 2019 and entitled Playyard is hereby incorporated by reference in its entirety into this application.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A playyard apparatus comprising:

a) a frame, the frame being endless, the frame having upper junctions, intermediate junctions, and lower junctions, the frame being a scissoring frame;

b) a flexible pen, the flexible pen engaged to the frame, the flexible pen disposed inwardly of the frame, the flexible pen including a sidewall, a lowermost floor, and an open top, the sidewall and lowermost floor being flexible, the sidewall being endless, a height of the sidewall being defined by a distance between a lower periphery of the sidewall and an upper periphery of the sidewall, the lowermost floor being engaged to the lower periphery of the sidewall;

c) the frame and flexible pen being foldable up from an open configuration into a closed configuration for storage with the flexible pen disposed inwardly of the frame;

d) the frame and flexible pen being foldable out from said closed configuration to said open configuration with the flexible pen disposed inwardly of the frame;

e) an upper floor, the upper floor being flexible, the upper floor being disposed at a greater elevation than the lowermost floor, the upper floor being engagable to the flexible pen, and the upper floor being disengagable from the flexible pen;

f) the upper floor being immediately adjacent to the lowermost floor when the upper floor is engaged to the flexible pen;

g) a zipper between the upper floor and the flexible pen, wherein the zipper includes an inner portion engaged to the upper floor and an outer portion engaged to the flexible pen, each of the inner and outer portions of the zipper having interlocking elements, the inner and outer portions of the zipper being engaged to each other by the interlocking elements; and h) wherein the upper floor includes an outermost periphery, wherein the upper floor includes an underside, wherein the inner portion of the zipper is engaged to the underside of the upper floor, and wherein the inner portion of the zipper is spaced from the outermost periphery of the upper floor.

2. The playyard apparatus of claim 1, wherein the sidewall and lowermost floor are engaged to each other at a junction, and wherein a disengagement of the lowermost floor from the sidewall destroys an integrity of the junction between the sidewall and lowermost floor.

3. The playyard apparatus of claim 1:

a) wherein the upper floor includes an upper floor periphery, an underside, and an inner zipper portion, the inner zipper portion having an inner flexible strip and inner teeth on an outer edge of the inner flexible strip, the inner flexible strip being engaged to the underside of the upper floor, the inner flexible strip being spaced from the upper floor periphery and the inner teeth of the inner flexible strip being spaced from the upper floor periphery;

b) wherein the flexible pen includes an outer zipper portion, the outer zipper portion having an outer flexible strip and outer teeth on an inner edge of the outer flexible strip, the outer flexible strip being engaged to the flexible pen and the outer teeth being spaced inwardly from the sidewall of the flexible pen;

c) the inner teeth of the inner zipper portion engaging the outer teeth of the outer zipper portion to engage the upper floor to the flexible pen; and d) the upper floor covering the inner and outer teeth, respectively, of the inner and outer zipper portions.

4. The playyard apparatus of claim 1, wherein the interlocking elements of the inner portion of the zipper are spaced from the outermost periphery of the upper floor.

5. The playyard apparatus of claim 1, wherein the upper floor extends over the interlocking elements of the inner portion of the zipper.

6. The playyard apparatus of claim 1, wherein the upper floor extends over the inner portion of the zipper.

7. The playyard apparatus of claim 1, wherein the upper floor extends over the interlocking elements of the outer portion of the zipper.

8. The playyard apparatus of claim 1, wherein the upper floor extends over the outer portion of the zipper.

9. The playyard apparatus of claim 1, wherein the lowermost floor includes an outermost periphery, and wherein the interlocking elements of the outer portion of the zipper are disposed inwardly of the outermost periphery of the lowermost floor.

10. The playyard apparatus of claim 1, wherein the interlocking elements of the outer portion of the zipper are disposed inwardly of the sidewall.

11. The playyard apparatus of claim 1, wherein the sidewall and lowermost floor form a junction, and wherein the interlocking elements of the outer portion of the zipper are disposed inwardly of the junction of the sidewall and lowermost floor.

12. The playyard apparatus of claim 1, wherein interlocking elements comprise teeth, wherein the upper floor includes a resilient pad extending between opposing portions of a periphery of the upper floor, and wherein the resilient pad covers the interlocking elements of the inner portion of the zipper.

13. The playyard apparatus of claim 1, wherein the interlocking elements comprise teeth, wherein the upper floor includes a resilient pad extending between opposing portions of a periphery of the upper floor, and wherein the resilient pad covers the interlocking elements of each of the inner and outer portions of the zipper.

14. The playyard apparatus of claim 1, wherein the interlocking elements comprise teeth, wherein the upper floor includes a resilient pad extending between opposing portions of a periphery of the upper floor, and wherein the resilient pad covers each of the inner and outer portions of the zipper.

15. The playyard apparatus of claim 1, wherein the interlocking elements comprise teeth, wherein the upper floor includes a resilient pad extending between opposing portions of a periphery of the upper floor, wherein the resilient pad covers the interlocking elements of the inner portion of the zipper, wherein the upper floor includes sheeting encapsulating the resilient pad, wherein the inner portion of the zipper is engaged to the sheeting, and wherein the outer portion of the zipper is engaged to the flexible pen.

16. The playyard apparatus of claim 1, wherein the interlocking elements comprise teeth, wherein the upper floor includes a resilient pad extending between opposing portions of a periphery of the upper floor, wherein the resilient pad covers the interlocking elements of the inner portion of the zipper, wherein the upper floor includes sheeting encapsulating the resilient pad, wherein the inner portion of the zipper is engaged to the sheeting, and wherein the outer portion of the zipper is engaged to the lowermost floor of the flexible pen.

17. The playyard apparatus of claim 1, wherein the interlocking elements of the outer portion of the zipper are spaced from a periphery of the lowermost floor.

18. The playyard apparatus of claim 1, wherein the upper floor includes an underside, wherein the inner portion of the zipper is disposed adjacent to a periphery of the upper floor on the underside of the upper floor, wherein the underside of the upper floor is free of quick connect mechanisms disposed inwardly of the inner portion of the zipper, and wherein an upper side of the lowermost floor is free of quick connect mechanisms disposed inwardly of the outer portion of the zipper.

19. A playyard apparatus comprising:

a) a frame, the frame being endless, the frame having upper junctions, intermediate junctions, and lower junctions, the frame being a scissoring frame;

b) a flexible pen, the flexible pen engaged to the frame, the flexible pen disposed inwardly of the frame, the flexible pen including a sidewall, a lowermost floor, and an open top, the sidewall and lowermost floor being flexible, the sidewall being endless, a height of the sidewall being defined by a distance between a lower periphery of the sidewall and an upper periphery of the sidewall, the lowermost floor being engaged to the lower periphery of the sidewall;

c) the frame and flexible pen being foldable up from an open configuration into a closed configuration for storage with the flexible pen disposed inwardly of the frame;

d) the frame and flexible pen being foldable out from said closed configuration to said open configuration with the flexible pen disposed inwardly of the frame;

e) an upper floor, the upper floor being flexible, the upper floor being disposed at a greater elevation than the lowermost floor, the upper floor being engagable to the flexible pen, and the upper floor being disengagable from the flexible pen;

f) the upper floor being immediately adjacent to the lowermost floor when the upper floor is engaged to the flexible pen;

g) a zipper between the upper floor and the flexible pen, wherein the zipper includes an inner portion engaged to the upper floor and an outer portion engaged to the flexible pen, each of the inner and outer portions of the zipper having interlocking elements, the inner and outer portions of the zipper being engaged to each other by the interlocking elements; and h) wherein the upper floor includes an outermost periphery, wherein the upper floor includes an underside, wherein the inner portion of the zipper is engaged to the underside of the upper floor, and wherein the interlocking elements of the inner portion of the zipper are spaced from the outermost periphery of the upper floor.

* * * * *